US007666118B1

(12) United States Patent
Anthony

(10) Patent No.: US 7,666,118 B1
(45) Date of Patent: Feb. 23, 2010

(54) FREE-WEIGHT EXERCISE MONITORING AND FEEDBACK SYSTEM AND METHOD

(76) Inventor: Donald D. Anthony, 1312 Dorney Ave., Allentown, PA (US) 18103

( * ) Notice: Subject to any disclaimer, the term of this patent is extended or adjusted under 35 U.S.C. 154(b) by 0 days.

(21) Appl. No.: 11/486,410

(22) Filed: Jul. 13, 2006

Related U.S. Application Data

(63) Continuation-in-part of application No. 10/917,039, filed on Aug. 12, 2004.

(51) Int. Cl.
*A63B 71/00* (2006.01)
*A63B 21/078* (2006.01)

(52) U.S. Cl. ..... 482/8; 482/104

(58) Field of Classification Search ..... 482/1, 482/3–4, 7, 8–9, 93–94, 98–99, 900–902, 482/104; 600/587, 595; 73/379.01; 434/247; *A63B 71/00, A63B 21/078*

See application file for complete search history.

(56) References Cited

U.S. PATENT DOCUMENTS 5,314,394 A * 5/1994 Ronan ..... 482/104
6,358,188 B1 * 3/2002 Ben-Yehuda et al. ..... 482/8
6,685,480 B2 * 2/2004 Nishimoto et al. ..... 434/247
7,090,621 B2 * 8/2006 Loane ..... 482/71
7,163,488 B2 * 1/2007 Anders et al. ..... 482/4
7,455,621 B1 * 11/2008 Anthony ..... 482/8
2001/0000408 A1 * 4/2001 Hair et al. ..... 250/224
2003/0032529 A1 * 2/2003 Alessandri et al. ..... 482/94
2005/0233871 A1 * 10/2005 Anders et al. ..... 482/93

* cited by examiner

*Primary Examiner*—Loan H Thanh
*Assistant Examiner*—Oren Ginsberg
(74) *Attorney, Agent, or Firm*—Charles A. Wilkinson; Clinton H. Wilkinson

(57) ABSTRACT

An exercise data collection system and method of collection of data concerning the performance of weightlifters and the like which can be retrofitted for use with a power rack or half rack used by weightlifters and detached after use or alternatively set up in a freestanding arrangement, such as for use on a platform, in which by emitted electromagnetic radiation coupled detectors the movements of a barbell past such emitters is detected by the reflected emission and the speed of passage calculated by determining the interval between reflection of the detector beams between adjacent detectors, the height of such reflection beam being related to the portion of the musculature of the weightlifter that is undergoing extension or retraction during exercise.

10 Claims, 25 Drawing Sheets

PRIOR ART

FREE-WEIGHT EXERCISE MONITORING AND FEEDBACK SYSTEM AND METHOD

CROSS-REFERENCE TO PREVIOUS RELATED APPLICATION

This application is a continuation-in-part of U.S. application Ser. No. 10/917,039 filed on Aug. 12, 2004 by the same inventor and claims priority therefrom.

BACKGROUND OF THE INVENTION

1. Field of the Invention

The present invention relates to the fields of exercise devices and weightlifting, and more particularly the present invention relates to a system and method for measuring and tracking certain exercise parameters when performing a weightlifting exercise, and more particularly still to a portable free-weight exercise data gathering and feedback system and method whereby a motion sensor means connected to an electronic evaluation circuit and a means for displaying data concerning the exercise movements performed is provided.

2. Preliminary Discussion

Most newer weightlifting type exercise devices today are weight stack type machines, wherein a vertical stack of weights or plates is slidably arranged on guides, and a pulley, lever, and cable system including a handle is used by an exerciser to perform pulling, pressing, or lifting repetitions. Typically, the user selects the amount of weight to be lifted by placing a pin in the stack such that it passes underneath a particular or set number of weight plates and secures them to the guides. Despite the current popularity of such machines, which is due to their ease of use and the easily adjusted variable resistance of such machines, not to mention the safety feature of having the weight stack operate on guide rods, most serious or competition level weightlifters prefer to train in large part using free-weights, such as barbells and dumbbells, particularly when training using very heavy weights. While weight stack machines can be used to isolate and train particular muscles, such machines usually cannot mimic the natural lifting motion of a free-weight exercise closely enough to satisfy seriously training or elite athletes. In addition, free-weight lifting uses only the leverage created by the user's body and muscles, and is not supplemented by a machine. Competitive weightlifters, furthermore, are likely to train using free-weights rather than machines in training for their particular lifting event.

The most common free-weight exercises performed using a barbell with heavy weights are squat exercises and exercises using a so-called bench press. In performing a squat or squat lift exercise, which is essentially a deep knee bend, a frame apparatus, often referred to generally as a "power rack", is often used to aid the exerciser in grasping and positioning the barbell on his or her shoulders, so that the exercise is performed in a safe manner preventing injury to the weightlifter or possibly to bystanders. Bench press routines are also frequently performed in the confines of a frame or power rack apparatus. A power rack typically consists of a rectangular frame made of steel tubing comprised of pairs of front and rear vertical uprights or corner posts, usually also rectangular, connected together at their upper and lower ends to form a rigid open protective structure. Each vertical upright typically is provided with a series of spaced apart and aligned apertures or through-holes into which horizontal spotter arms or barbell support hooks may be adjustably secured. To perform the squat exercise, the barbell is placed on the support hooks at a height just below the shoulders of the exerciser. The exerciser will then position the barbell across his or her shoulders, grasp the barbell, lift the barbell upwardly slightly so that it is removed from the support hooks, move to a comfortable position away from but between the front and rear vertical uprights in the center of the rack, and perform the squatting exercise with all of the weight of the barbell being supported by the exerciser. As the barbell is moved upwardly and downwardly between the pairs of vertical uprights of the power rack, the outer ends of the barbell are long enough so that they extend beyond the outer edges of the front and rear corner posts of the rack. So-called horizontal "spotter" bars are thus often positioned extending between the front and rear posts at a height just below the lowest point of the range of motion of the squat exercise to serve as a safety barbell catching means. If the lifter is unable to complete a repetition or starts to lose control of the barbell, he or she can if possible place the barbell back on the support hooks, or if not possible he or she can simply rest it on or drop it completely on the horizontal spotter bars.

In addition to the simple frame or power rack apparatus described above, a large number of modified power rack devices are available. For example, the well known so-called "Smith machine" includes barbell guiding elements on or adjacent the front vertical uprights to which the barbell is rigidly connected. The guiding elements slide up and down on the vertical uprights as the squat exercise is performed, which keeps the barbell level during each repetition. In addition, a latch means on the barbell enables it to be hooked and unhooked from the upright at various vertical positions by twisting the barbell to move the latch toward or away from the apertures. Half racks, wherein there are only two vertical posts or uprights rather than four, are also increasingly popular. Other free-weight exercises, such as the bench press, curls, and the like, can be performed using the power rack or Smith machine, as well as one or more similar frame apparatus devices such as the half rack. Nevertheless, most serious weightlifters usually prefer to use the basic power rack, since the lifting motion is not restricted to a strictly up and down or vertical motion, which is somewhat unnatural.

As indicated above, frame apparatus such as the power rack, half rack, or other similar specialized machines and devices enable squat or other free-weight exercises to be performed more safely without the assistance of a human spotter, as such racks, in effect, include an integral safety spotter. While such equipment enables the exercises to be performed more safely, there is usually no means for providing exercise parameter feedback to the user. Weightlifters will typically keep a log book or record listing each exercise performed, the number of repetitions, and the amount of weight lifted in each exercise. In this way, the weightlifter can compare the amount of exercise accomplished during one period with the amount of exercise accomplished during the previous period, thereby monitoring his or her performance over time. However, while such data is certainly useful, it is also quite limited and gives little indication as to the manner in which each exercise or repetition is performed. For example, on one day a squat exercise might be performed at a faster pace or with a fuller range of motion than on another day, or the exerciser may fatigue more quickly and his or her pace may be faster over the first several repetitions but may slow over the later repetitions. In each instance, the exerciser will likely only record in his or her log book the number of repetitions completed, with no further indication as to the manner in which the repetitions were completed, except for possibly a few usually one or two words comments. Little feedback information or data, therefore, is available to the exerciser that may aid him or her in exercising in a more efficient or proper manner.

Recognizing the need to provide more detailed exercise parameter data and feedback to weightlifters, and in particular to those performing free-weight exercises, the present inventor has now provided a retrofittable detection device mountable on a power rack or similar apparatus such as a half rack which uses simple electronic detection means to provide detailed data concerning the performance of weightlifting exercises performed using a safety apparatus such as a power rack, half rack, or the like, although the device is also capable of being used in a freestanding orientation.

3. Description of Related Art

A search of the prior art references has revealed a large number of inventions related to the field of monitoring performance of an exercise and providing exercise parameter data or feedback to an exerciser. However, none provide the data in the manner and variety or as conveniently as the system of the present invention or anticipate or disclose the device and method of the present invention. The most relevant patent references known to the present inventor are discussed hereinbelow.

U.S. Pat. No. 4,907,795 issued to B. F. Shaw et al. on Mar. 13, 1990, entitled "COMPUTERIZED EXERCISE MONITORING SYSTEM AND METHOD OF MONITORING A USER'S EXERCISE PERFORMANCE," discloses a system for comparing one's exercise performance with past performances, thereby encouraging a more efficient workout. Provided is a portable memory unit that can be plugged into various weight stack type exercise machines and then used to record exercise data. Each weight stack machine used with the memory unit has a screen or monitor for displaying such performance data attached. Shaw et al. utilizes a disc situated between infrared detector sensors and having spaced holes in it. The disc rotates in response to movement of a chain attached to the weight stack. Pulse signals from the infrared detector sensors caused by interruption of the beam by the rotating disc are sent to the computer system, which uses the pulses to track the position of the weight stack. The Shaw system therefore depends upon movement of the weight stack chain to move the disc and to interrupt the infrared signal, and therefore is not designed to be used in a free-weight lifting environment.

U.S. Pat. No. 5,260,870 issued to K. Tsuchiya et al. on Nov. 9, 1993, entitled "APPARATUS FOR MEASURING INSTANTANEOUS POWER BY LEG-STRETCHING POWER," discloses an apparatus for measuring one's leg power including a seat, drive system unit, a slide rail having a foot plate slidably secured, foot load and rotation frequency sensors, and a control panel having an LED display. When the user presses his or her feet against the foot plate, the device calculates the foot pressing force, average power, and the like. Tsuchiya et al. does not teach the use of light sensors to detect a range of motion as in the present invention, however.

U.S. Pat. No. 5,314,394 issued to J. J. Ronan on May 24, 1994, entitled "SPOTTING APPARATUS FOR ASSISTING A WEIGHTLIFTER," discloses a unit for assisting a weightlifter upon partial muscle failure during a workout, as well as a system for monitoring the position of a weight within a range of movement. The barbell is supported on arms connected to a slidable arm support assembly in turn connected to a support structure, which also includes a counterweight and a power assist unit. A lower position sensor detects when the barbell has been moved to a low position and activates the power assist unit to aid in lifting the barbell. A speed sensor detects the speed and direction a wheel is moving, which activates the power assist if the control unit determines that the barbell is moving too quickly or slowly. While Ronan illustrates a weightlifting apparatus having various sensors for measuring the rate or speed of movement of a barbell during exercise, such sensors are not light sensors. In addition, the Ronan apparatus is primarily a lifting assist device, rather than a system for monitoring one's exercise performance. Furthermore, the barbell is coupled to the apparatus, which limits the range of motion of the lifting exercise.

U.S. Pat. No. 5,331,851 issued to A. Parviainen et al. on Jul. 26, 1994, entitled "METHOD FOR MEASURING THE WORKING CONDITION OF MUSCLES AND MEASURING AND TRAINING SYSTEMS FOR MEASUREMENTS OF THE WORKING CONDITION OF MUSCLES AND FOR MUSCLE TRAINING." discloses an exercise measurement system and method wherein, broadly speaking, sensors connected to a data processing unit and display screen are attached to a piece of exercise equipment to measure and monitor various conditions experienced during muscle training. While the Parviainen et al. machine can calculate or detect parameters such as force, range of motion, rate of fatigue, and power, the system is designed for use with a weight stack-type machine, rather than in a free-weight lifting environment as with the present invention.

U.S. Pat. No. 5,458,548 issued to I. F. Crossing et al. on Oct. 17, 1995, entitled "FITNESS QUANTIFICATION EXERCISER," discloses a device, preferably a potentiometer, which acts as an encoder and generates pulses which detect the degree of movement of a shaft. The pulses are fed into a micro processor, and the number of pulses is then used to calculate the distance traveled by the exerciser. In addition, a heart monitor is worn by the exerciser to measure his or her heart rate, which information is then processed and displayed on a display screen.

U.S. Pat. No. 5,653,669 issued to C. L. Cheng on Aug. 5, 1997, entitled "UNIVERSAL GYM WITH UNIFORM RESISTANCES," discloses a cable-type weightlifting apparatus having a lever-type strain gauge for detecting the force applied during exercise, which measurement is conveyed to the user via a monitor or similar display means. While the Cheng lever-type strain gauge as shown may be unique in combination with a universal gym, such invention is not similar to the present inventor's arrangement, and Cheng does not teach the use of light sensors to obtain data concerning exercise repetitions.

U.S. Pat. No. 5,655,997 issued to A. D. Greenberg et al. on Aug. 12, 1997, entitled "FITNESS FEEDBACK SYSTEM FOR WEIGHT STACK MACHINES," discloses a system for conveying exercise parameter data to users of weight stack type exercise machines. As the cables supporting the weight stack are moved, an encoder attached to the weight stack pin by a cable converts the linear motion of the cable and weight stack into a series of electrical impulses which are transmitted to an assembly that computes the speed and distance of the cable movement as detected by a pair of proximity sensors, which are aligned vertically with the weights. The proximity sensors may be photosensors which detect a reflective tape on the weight plates, with a light source placed on one side of the weight stack and light detectors placed so as to detect motion of the weight stacks and the number of weights in a stack. The computations are then displayed on a display device. Greenberg et al. provides a means for obtaining data by measuring the movement of a weight stack using sensors. However, Greenburg et al. does not use multiple light sensors to measure multiple ranges of motion of the weight stack, and therefore is incapable of matching the accuracy of the speed, direction, and other measurements taken using the present inventor's system. The light detectors also are not mounted or movable as in the present invention, which is designed primarily for use in free-weight lifting, rather than with weight stack machines. See also U.S. Pat. No. 5,785,632 also issued to A. D. Greenberg et al. on Jul. 28, 1998, entitled "FITNESS FEEDBACK SYSTEM FOR WEIGHT STACK MACHINES," which is a divisional patent of U.S. Pat. No. 5,655,997.

U.S. Pat. No. 5,667,460 issued to R. S. Smith on Sep. 16, 1997, entitled "BALLISTIC FORCE EXERCISER," discloses a means for measuring ballistic force, or the force generated by momentum exchange during a weightlifting exercise repetition. A time switch and counter switch are connected to an upright of a power rack, which records the lowering and raising of the barbell, from which the ballistic force can be measured. While Smith illustrates a unique system for measuring one's exercise performance, Smith does not include a light sensor means for determining the position of the ends of a barbell at various points in a weightlifting exercise repetition, or a similar display means for displaying such information. The Smith invention also is not designed for use in free-weight lifting, as the barbell is rigidly and slidably connected to the power rack in such invention.

U.S. Pat. No. 5,827,154 issued to J. C. Gill on Oct. 27, 1998, entitled "CONCENTRIC/ECCENTRIC EXERCISE APPARATUS," discloses a leg exercising machine having a control for monitoring or selecting the speed at which the apparatus can be moved, including both positive and negative movements. Such apparatus is provided primarily as a safety feature rather than an exercise measuring feature.

U.S. Pat. No. 5,916,063 issued to N. Alessandri on Jun. 29, 1999, entitled "PORTABLE MEMORY-MEDIATED SYSTEM AND METHOD FOR PROVIDING CUSTOMIZED TRAINING PROGRAM FOR USER OF PLURAL UNITS OF EXERCISE APPARATUS," discloses an exercise system wherein each exercise apparatus in a gym or workout area is connected to a central system computer so that exercise results taken from any single piece of equipment can be monitored and gathered into an overall workout regimen. While such system includes a graphic display for such information, and can monitor one's workout schedule and provide feedback concerning the timing and intensity of such workouts, Alessandri does not appear to anticipate the present inventor's system and method for improving one's training on a free-weight lifting apparatus.

U.S. Pat. No. 6,149,550 issued to D. Shteingold on Nov. 21, 2000, entitled "MUSCLE STRENGTH TESTING APPARATUS," discloses a bar-like apparatus hingedly connected between two vertical posts. A plurality of tension sensors, preferably piezo-electric sensors, are provided so that when a force is applied to the apparatus, such force is computed and a reading is displayed on a display unit. A horizontal force measuring unit is also provided secured to each post. While Shteingold uses sensors to determine exercise parameter data, such sensors respond to tension as opposed to the light sensors used by the present inventor, which record when a barbell passes through or interrupts the light path.

U.S. Pat. No. 6,190,287 issued to L. M. Nashner on Feb. 20, 2001, entitled "METHOD FOR MONITORING TRAINING PROGRAMS," discloses a workout monitoring means including a display and a remote computer controlling or monitoring device attached to an exercise quality and quantity measuring device, such as a force plate. Nashner uses mathematical algorithms to measure performance, but the physical movements of the user are not measured using sensors to determine the range of motion of such exercise.

U.S. Pat. No. 6,224,512 issued to U. Arnesson on May 1, 2001, entitled "TEST AND TRAINING DEVICE AND METHOD," discloses a method and device for performing static and dynamic strength tests as well as for training the leg and knee areas. Such device includes a force measuring means, a display screen, and a keyboard for controlling the device, but light sensors are not used to record data related to each exercise performed.

U.S. Pat. No. 6,228,000 issued to A. A. Jones on May 8, 2001, entitled "MACHINE AND METHOD FOR MEASURING STRENGTH OF MUSCLES WITH AID OF A COMPUTER," discloses an exercise device including a force measuring device such as a strain gauge which measures the force exerted by an exerciser to determine the strength of such person's muscles. A device for measuring the angle of one's body is also provided. Such information is then displayed on a screen. Although the invention is used with a variety of different exercise machines, a light sensor does not appear to be used in any of such different embodiments.

U.S. Pat. No. 6,231,481 issued to K. B. Brock on May 15, 2001, entitled "PHYSICAL ACTIVITY MEASURING METHOD AND APPARATUS," discloses an apparatus for measuring the power generated by an exerciser, which apparatus may be used either with free weights, free weight machines, or cable-type machines. Exercise parameters such as velocity and acceleration are measured and displayed on a display screen. Although infrared or laser sensors/transducers may be used with the invention, Brock shows only mechanical connections and does not arrange one or more pairs of light sensors to a weightlifting power rack apparatus or in a freestanding arrangement to measure exercise movements as in the present invention.

U.S. Pat. No. 6,261,205 issued to P. M. Elefson on Jul. 17, 2001, entitled "RESISTANCE TRAINING APPARATUS," discloses a vertical rack support upon which a barbell may be mounted or clamped. The apparatus detects when movement of the barbell is decelerated in a positive movement as a result of tiring of the exerciser and begins to aid in moving the barbell, or if the negative movement is accelerated in a negative direction as a result of tiring, the device will slow the movement. The machine replaces a human spotter in the practice of so-called forced repetition by weightlifters. The device is therefore basically a variation of the Ronan disclosure of the U.S. Pat. No. 5,314,394 patent.

U.S. Pat. No. 6,358,188 issued to R. Ben-Yehuda et al. on Mar. 19, 2002, entitled "EXERCISE TRACKING SYSTEM", discloses a tracking system wherein reflectors are placed on a side edge of each plate in a weight stack, while a detector connected to a computer via either a hard wire or wireless connection is placed adjacent the reflectors. A user interface including a display screen and card reader is connected to a computer. The detector includes a light source aimed at the reflectors on the weight stack and a light detector, so that during exercise the movement of the weights is detected, with the time of reflections being indicative of the speed and direction of a lift. Using such measurements, various data can be calculated. Since the Ben-Yehuda system depends on reflection of light off of the weight stack, such system could not be adapted for use when lifting free-weights with a power rack or even using a "Smith machine" arrangement. In addition, the use of multiple pairs of detectors enables the present inventor to generate more detailed exercise parameter data than is possible with the Ben-Yehuda et al. system.

U.S. Patent Application Publication No. 2003/0032529 by N. Alessandri et al. and published on Feb. 13, 2003, entitled "Remote Measuring Device for an Exercise Machine with Counterweights", discloses another measuring system for use with weight stack type exercise machines, whereby a signal indicative of the position of the weight stack pin is generated by an element attached to the pin, and such signal is detected by a stationary detection device. Such signal is preferably an ultrasonic signal, although visible or infrared light waves may be used.

German Patent No. DE 3807038 C1 issued to P. Beutel and published on Sep. 28, 1989, entitled "Arrangement for Collecting Training Data for Mechanical Training Equipment", discloses an electronic control unit that is attached to a piece of training equipment for collecting and recording training data. A portable data carrier is used to output the data, which is collected by a contactless sensor such as a magnetic proximity sensor which senses movement of the training equipment. For example, the sensor may be placed adjacent a weight stack, a permanent magnet attached to each plate in the stack, and movement is sensed and recorded, and then shown on an LCD display. Such arrangement is not closely similar to the present inventor's light bar system and method.

German Patent No. DE 3914437 C1 issued to H. Leutheuser and published on Nov. 16, 1989, entitled "Device for Carrying Out Training Exercises", discloses an exercise apparatus having a sensor device for sensing movement of the user or apparatus that is operably connected to an electronic circuit for evaluating the signals detected by the sensors. The sensor device is comprised of an electro-optical transmitter, such as an LED light, and a receiver, so that when the light is interrupted, such interruption is detected and recorded. From this data, simple exercise parameters such as the number of repetitions may be determined. Heinz however uses only a single light sensor to record movement of a barbell or the like, so that the amount of data available is severely limited in comparison to the present inventor's multiple sensor arrangement, wherein detailed information concerning single repetitions as well as overall and historical workout data can be determined.

While the use of sensors to detect and record exercise repetitions and movements is therefore shown in various references available in the prior art, and while each of the devices disclosed in such references is useful in its own respect, none of the known arrangements solves the problems addressed by the present invention, wherein multiple measurements are taken and evaluated during single exercise repetitions by electromagnetic wave detection apparatus, preferably infrared light beams. For example, during a bench press or squat exercise, the present inventor may position multiple sensors on either side of the barbell being lifted. As the barbell is moved within a range of motion during each repetition, such movement will by or through interruption of the light beam by the barbell be detected and recorded by each sensor device. For such measurements, in addition to simple calculations such as the number of repetitions completed, a multitude of additional data is available, such as whether the barbell is moving at a slightly faster speed during certain parts of the repetition, whether the barbell is being held parallel or whether it is leaning to one side so that one side is being lifted ahead of the other, and the like. Such detailed information is extremely valuable in evaluating and improving one's exercise routine, and may be used to ascertain certain strengths and weaknesses of the exerciser, as well as to track the exerciser's progress over time. By detecting certain patterns or weaknesses, such weaknesses can be addressed and corrected, thereby improving the overall conditioning process. Applicant's apparatus, furthermore, is designed in one embodiment to be easily and conveniently mounted upon existing power racks or half racks either as a permanent retrofit or as a temporary provision of data collection apparatus provided for a particular weightlifter, and may be designed and or calibrated especially for a particular weightlifter enabling lifters to have available their own lift measuring system in a gym environment. Alternatively, the apparatus may be provided in a freestanding arrangement and used with a conventional bench press or other exercises wherein a weight, limb, body part, or other device is repeatedly moved through a range of motion, or even completely embedded in the frame of a power rack or half rack. The apparatus and method are particularly designed for use in a free-weight lifting environment, where there is a need for a system for gathering and interpreting exercise data, and where most professional and serious weightlifters are likely to concentrate their workout routines.

OBJECTS OF THE INVENTION

It is therefore a primary object of the invention to provide a system and method for gathering exercise parameter data and for conveying such data to the user.

It is a further object of the invention to provide a system and method for improving the physical performance of a weightlifter undertaking a weightlifting exercise.

It is a still further object of the invention to provide a system and method for gathering exercise parameter data during performance of an exercise such as a squat or bench press exercise, whereby such information is used to measure the quality and/or efficiency of each repetition to be measured and archived.

It is a still further an object of the invention to provide a support frame apparatus such as a power rack having attached a plurality of spaced apart sensors capable of gathering exercise parameter data during the performance of an exercise.

It is a still further object of the invention to provide a portable exercise feedback system that is simple to use and quick and easy to attach or retrofit for use with existing exercise machines and equipment.

It is a still further object of the invention to provide a portable exercise feedback system comprised of a plurality of sensor devices that may be attached either individually or in a housing to a surface such as the vertical uprights of a power rack, and wherein said sensor devices are light diodes and photo sensors or particularly infrared detector pairs which are arranged so that a barbell will pass through or interrupt the light curtain created by said sensors, which interruption will be transmitted as electronic pulses to a microprocessor where they are interpreted by such microprocessor into meaningful exercise parameter data that can be displayed on a user interface such as a touch screen display or the like.

It is a still further object of the invention to provide an exercise feedback system comprised of a plurality of sensor devices connected in a support frame which may or may not be freestanding.

It is a still further object of the invention to provide a retrofittable exercise monitoring system for use by free-weight lifters in conjunction with a power rack to monitor and record detailed parameters of movement of such weightlifter during training exercises.

It is a still further object of the invention to provide a method of collecting exercise performance data by a portable or retrofittable apparatus in weightlifting conditioning.

It is a still further object of the invention to provide an exercise feedback system which can be utilized with a half rack.

Still other objects and advantages of the invention will become clear upon review of the following detailed description in conjunction with the appended drawings.

SUMMARY OF THE INVENTION

The foregoing objects are attained in the present invention by providing a system and apparatus including multiple detector couples comprised of one-directional electromagnetic wave emitting and electromagnetic wave detecting elements, the electromagnetic waves preferably being light beams and particularly infrared beams, and the elements preferably being housed in linearly extended casings. The casings are adapted to be retrofittably attached to the corner posts of a frame apparatus such as a power rack commonly used as a safety or spotter device when performing free-weight lifting exercises with a barbell such that the ends of a barbell bisect the unidirectional electromagnetic waves or light beams between the emitters and detectors, causing activation of the detectors. Based upon the time interval between two consecutively bisected light beams, the speed of movement and location of said barbell at any given time can be determined, plus by knowing such location and rate of change, the rate of change in either a positive or negative direction of the anatomical appendage of the exerciser can be determined. In another embodiment, the wave emitting and wave detecting elements are housed in a single linear extended casing which when secured to the vertical upright posts of a frame apparatus such as a power rack, half rack or combo rack, the barbell reflects the directional electromagnetic waves or light beams sent by the emitter back to the corresponding detector of the mating emitter, causing activation of the detector. The detection couples may also be freestanding rather than attached to posts of a power rack, half rack or combo rack, or even embedded completely in the vertical supports of a power rack, half rack, combo rack or other similar frame device.

DESCRIPTION OF THE PREFERRED EMBODIMENTS

Figure 1:
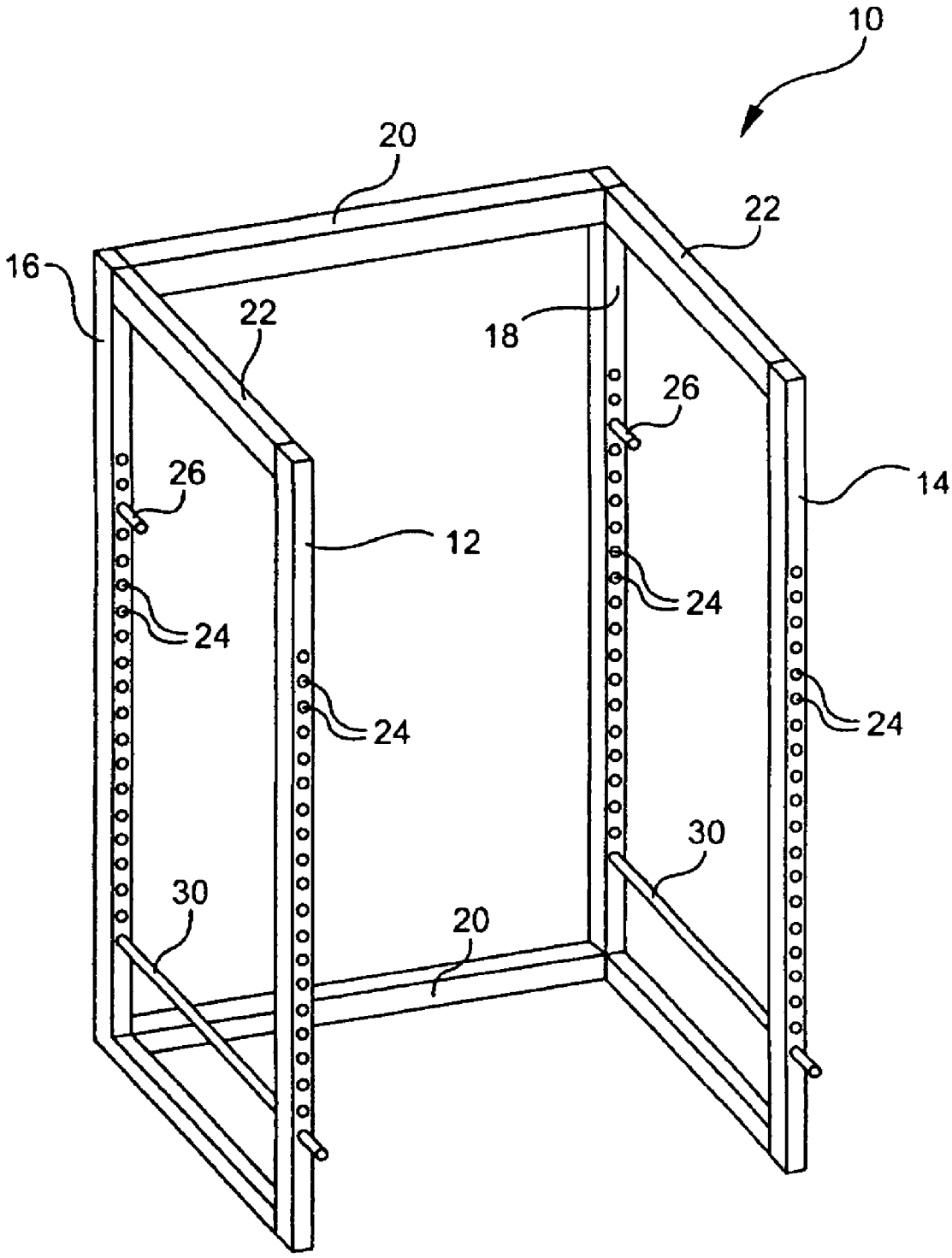
FIG. 1 is an isometric view of a prior art frame or power rack apparatus frequently used as a safety device when performing free-weight weightlifting exercises.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

While exercise performance or feedback systems are fairly widely available in one form or another in connection with various weight stack style exercise machines, or other cable and pulley type exercise machines, the number of systems available for use in a free weightlifting environment are minimal and have been largely limited to particular machines or applications. However, most professional or competition level athletes rely heavily on free-weight exercises with a barbell or dumbbell in their training regimens. It is this group of individuals who probably require the most detailed data and feedback concerning each repetition of an exercise performed and who would benefit the most from such detailed data. Such professional and elite athletes and their trainers either require or would be substantially benefited by easy access not only to repetition data, but also to speed of performance data not only for individual exercises but also with respect to rapidity of performance of component elements or steps of an overall exercise, not only so that rapidity of progress can be estimated, but also for safety reasons. For example, a weightlifter will often attempt to perform each exercise as many times as possible to the point of exhaustion or the point at which a single further repetition cannot be accommodated or performed. In such case, the exerciser will reach a point part way through the last attempted repetition at which no further movement or even support of the weight can be accommodated or accomplished. Traditionally, the lifter may if possible at this point simply allow the weight to fall to the nearest supporting surface, whether the floor or a cross piece or spotter bar of a power rack or the like, or, alternatively, have the weight load relieved or partially relieved by a "spotter," or second person standing by as a safety precaution. However, there will be a relative decrease in performance time of the presses or lifts of the weight several lifts before ultimate exhaustion, and if this relative decrease can be quantitized it may be possible to approach the muscle exhaustion point, but not to reach it, thereby preventing possible strains or worse, which strains or sprains or other actual injuries can only slow down training. A weightlifter furthermore may not readily detect that the speed or rapidity of performance of particular portions of his or her weightlifting routines is declining long before the exhaustion point, and therefore may not be gaining maximum training benefits. By providing detailed data regarding rapidity of individual components of an exercise, therefore, much better training can be attained.

The present inventor has recognized the relative paucity of available data collection and feedback systems for use in a free-weight lifting environment, and has conceived of a simple and relatively easy to use and operate system for providing detailed exercise parameter data the apparatus for the provision of which is in addition portable. The main data collection apparatus is in the form of a plurality of sensor devices, preferably photo sensors or infrared sensors, together with a plurality of matching emitters that may be attached to a surface such as the vertical uprights of a frame apparatus such as a power rack typically used in performing squats or other exercises. While such sensor devices or matched pairs of devices, broadly referred to as sensor devices could be integrally connected to or freestanding near such the vertical uprights, in preferred embodiments the sensor devices may be detachably coupled to such uprights by clamps or magnets on the base of the sensors, which enables the sensors to be quickly attached or retrofitted to the uprights. The sensors create a so-called light curtain extending vertically between the front and rear vertical uprights in the form of a series of horizontal radiation beams through which the ends of a typical barbell will pass when it is lifted or moved in an up and down motion or path, such as during a squat exercise. When the barbell moves through a beam directed at a paired sensor, it will block or interrupt the beam, which interruption will then be recorded as an electronic pulse that will be sent to a microprocessor or other computer memory device, where it will be converted into meaningful exercise parameter data. Such data may then be displayed to the user on an operator interface such as a touch screen or the like and may be otherwise manipulated, recorded, printed, or archived. Using the data generated by such system, both professional and recreational exercisers can obtain significant exercise performance data enhancement that will translate into better conditioning and stamina in such individuals.

Referring to FIG. 1, there is shown a general layout of a prior art frame apparatus or structure 10, typically called or labeled a power rack, of a type that is commonly used as an exercise equipment rack and safety device during the performance of free-weight leg squat and bench press exercises as well as various other free-weight lifting exercises with a barbell. Power rack 10 is comprised of first and second front corner posts or vertical uprights 12 and 14, and first and second rear corner posts or vertical uprights 16 and 18, all of which posts or uprights are preferably constructed of sturdy hollow rectangular steel tubing having similar dimensions and structural properties. Rear horizontal frame elements 20 are rigidly connected such as by welding between the upper and lower ends of first and second rear uprights 16 and 18, respectively. Similarly, pairs of side frame elements 22 are rigidly connected between the upper and lower ends of first front upright 12 and first rear upright 16, and between the upper and lower ends of second front upright 14 and second rear upright 18. While the dimensions of power rack 10 are variable, the corner posts or uprights should be both sturdy and spaced apart a sufficient distance so that such support frame apparatus is stable and strong enough to be used as a support for a barbell loaded with several hundred pounds of weights without tipping or collapsing. Both front vertical uprights 12 and 14 and rear vertical uprights 16 and 18 include a plurality of vertically spaced and horizontally aligned through-apertures or openings 24. Apertures 24 are adapted to receive pins 26 which are used to support a barbell 28, see FIG. 2, at a selected vertical height, usually with a first pin placed at a suitable height in an aperture in either vertical upright 12 or 16, and a second pin placed in an aperture in either vertical upright 14 or 18 at the same vertical height as the first pin, so that barbell 28 may be supported on the pins in a substantially horizontal position. Various types of pins or hooks of this type are known and available in the prior art. In addition, a pair of spotter bars 30 may be placed extending between horizontal apertures in first front and rear vertical uprights 12 and 16 and second front and rear vertical uprights 14 and 18, respectively. Spotter bars 30 are intended to catch barbell 28 if it is dropped or if the weightlifter is unable to complete an exercise repetition, or indeed any particular exercise at all, due to exhaustion, injury, or the like, and to prevent injury or further injury to a weightlifter or bystanders. The basic structure and arrangement of the frame apparatus or power rack 10 as described above is well known and obvious to those skilled in the art of weightlifting and familiar with exercise machines and similar equipment in general, and various modifications and improvements to this basic structure are also well known.

Figure 2:
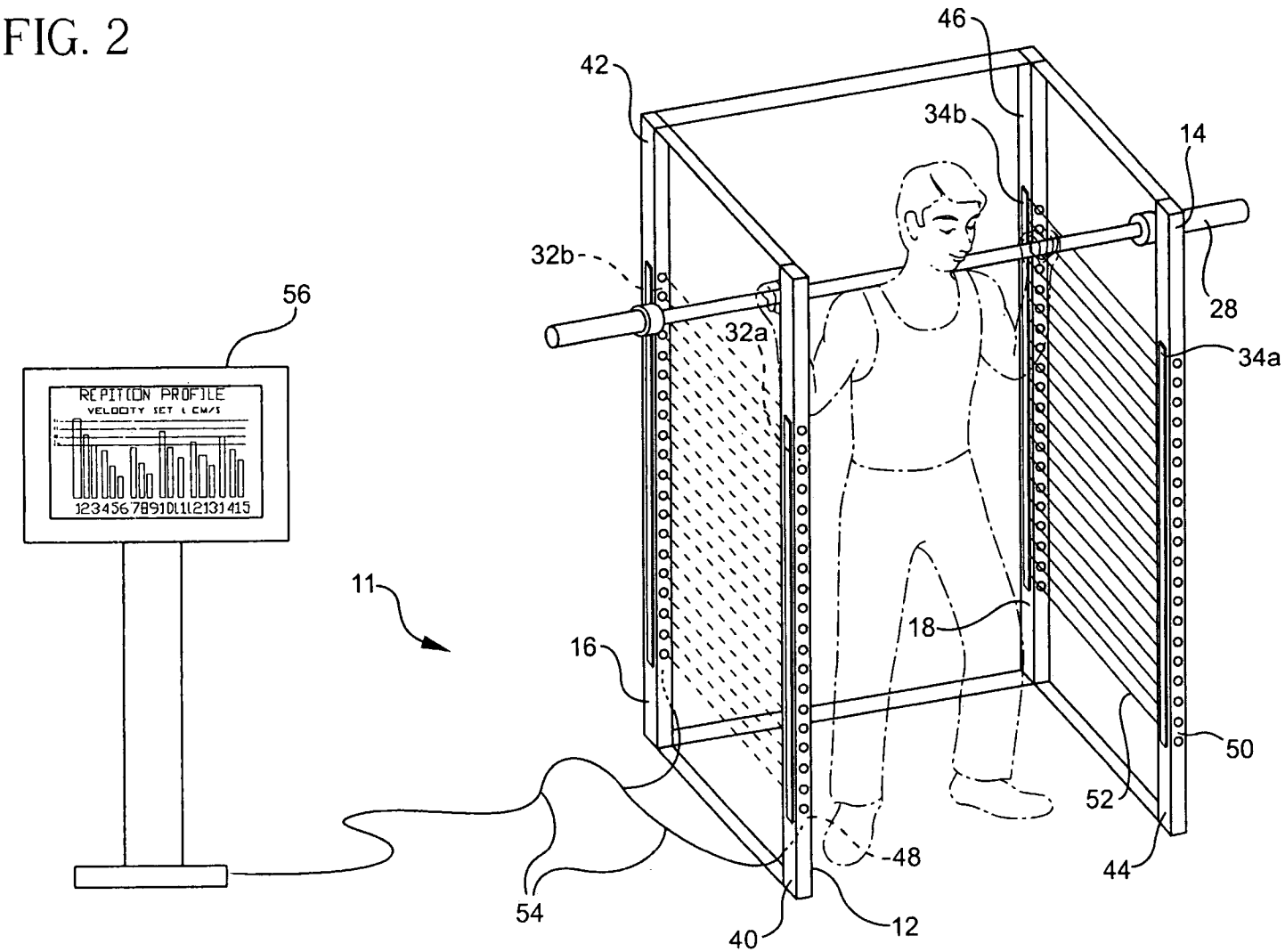
FIG. 2 is an isometric view of the frame or power rack apparatus shown in FIG. 1 with the retrofittable portable exercise feedback apparatus of the invention in use thereon with the light beams shown passing from the emitters to the detection devices.
Figure 3:
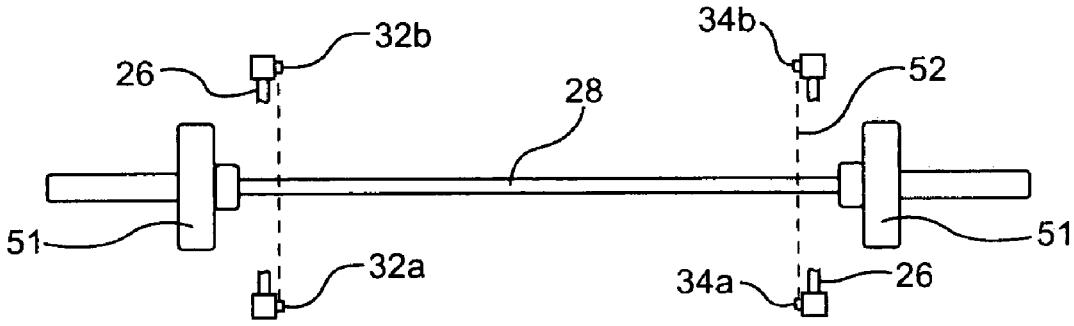
FIG. 3 is a diagrammatic view from the top of the detection device of the invention in use, again indicating the light pulses by straight lines extending from the emitters to the detectors of the invention.
Figure 4:
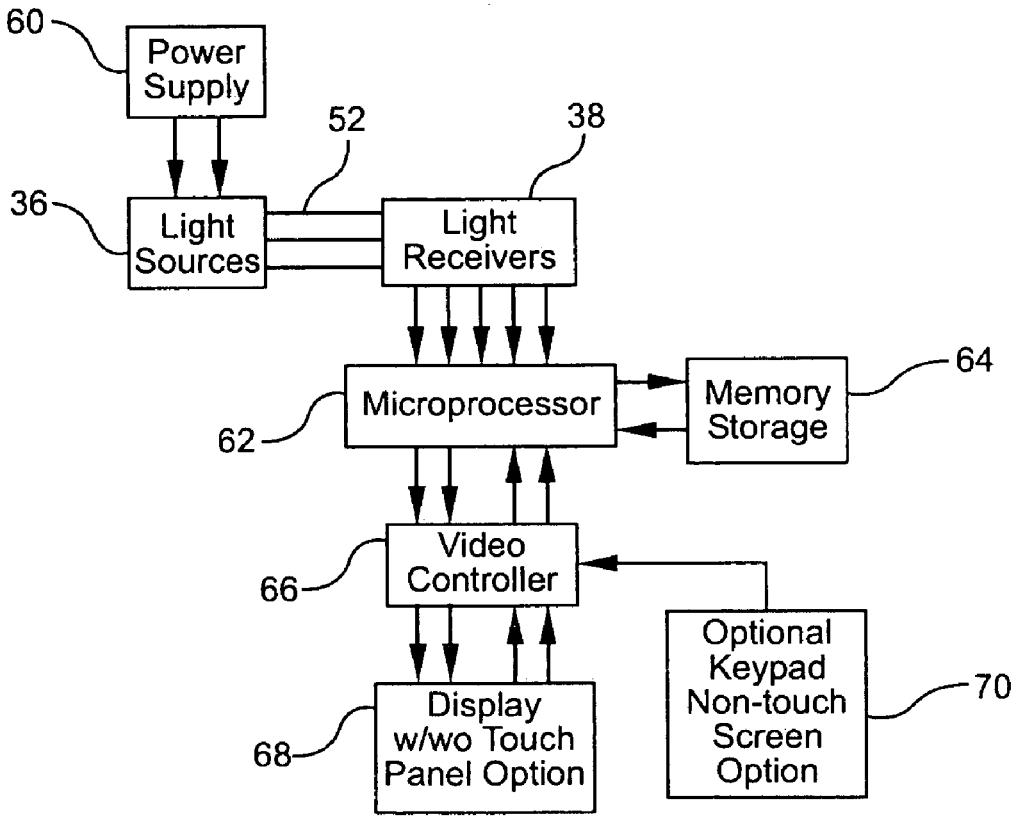
FIG. 4 is a flow diagram of the electronic operating portions of the apparatus.
Figure 5:
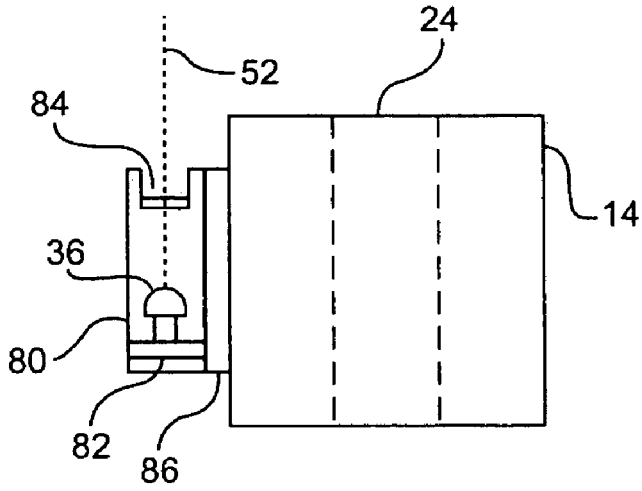
FIG. 5 is a top sectional view of the emitter portion of the apparatus of the invention applied to the corner post of a power rack.

FIGS. 2-9 illustrate a preferred embodiment of the exercise monitoring and data collection and feedback system 11 of the invention, while FIGS. 10-26 illustrates another preferred embodiment and various alternative embodiments as well as the method of use of the invention. Referring first to FIG. 2, there is shown a general layout of the data collection and feedback system 11 of the invention adapted for use with a prior art frame apparatus or power rack 10 as described with reference to FIG. 1. Attached to the corner posts or vertical uprights of power rack 10 are pairs of light bar units, or detection couples, with each detection couple or light bar pair comprising two sections indicated numerically as light bar sections 32*a-b* and 34*a-b*. While the construction of the light bars is described in greater detail below, in general terms, light bar sections or detection couples 32*a* and 34*a* house a plurality of light sources or emitters 36, while light bar sections 32*b* and 34*b* house a plurality of corresponding light sensors 38. In FIG. 2, light bar section 32*a* is shown connected to the outer side surface 40 of first front vertical upright 12 of power rack 10, light bar section 32*b* is connected to the outer side surface 42 of first rear vertical upright 16, light bar section 34*a* is connected to the inner side surface 44 of second front vertical upright 14, and light bar section 34*b* is connected to the inner side surface 46 of second rear vertical upright 18. Each light bar section 32*a-b* and 34*a-b* is secured to one of the vertical uprights by magnets 86, shown in larger scale in FIGS. 5 and 6, on the rear surface of the light bar sections. Alternatively, other attachment means, such as affixing the light bars with clamps 48 and 50 such as illustrated in FIG. 12 or providing through holes for bolts or screws in the light bars and vertical uprights, may be used. Use of magnetic attachment is particularly convenient and useful, and the inventor has found that attaching the light bars using magnets 86 makes it easy to attach or retrofit existing power racks 11 with the system of the present inventor. Light bar sections 32*a* and 34*a* on the front corner posts are arranged so that light beams or pulses 52 emitted from the plurality of light sources 36 housed therein, illustrated in FIG. 5, are directed substantially perpendicular to the floor surface, and directly towards the corresponding plurality of light sensors 38 housed in light bar sections 32*b* and 34*b*, respectively, illustrated in FIG. 6, on the rear corner posts, which—light sensors 38 are similarly arranged so that they can detect the light beams or pulses 52 emitted from light sources 36. Each light bar section 32*a-b* and 34*a-b* is then connected electronically by lines or wires 54 to a microprocessor 56, which connection is described in more detail below. Alternatively, as shown in FIG. 17, a wireless communication system may be provided.

In FIG. 2, to illustrate the possible alternate position of the light bars, light bars 32*a-b* are shown attached to the outer surface 42 of corner posts or uprights 12 and 16, while light bars 34*a-b* are shown attached to the inner surface 46 of posts or uprights 14 and 18. Thus, the light bars may be connected to either the inner side surfaces or outer side surfaces of the uprights, although the inventor has found that placing the light bars on the inner side surfaces, ala light bars 34*a-b*, is somewhat preferred since this eliminates the possibility that the light bars will be bumped or damaged by the weight plates 51, which will usually be situated during exercise on the outer sides of the corner posts. This is illustrated in FIG. 3, which is a diagrammatic top view indicating the typical position of barbell 28 as it passes through the light curtain created by pulses of light emitted from the light sensors. Both pairs of light bars 32*a-b* and 34*a-b* are attached in FIG. 3 to the inner surfaces of the posts or uprights, away from weight plates 51 for the reasons indicated. In an alternative arrangement, a single light bar paired with separate light source units and detector units, rather than two paired sets, may be provided on either uprights 12 and 16 or 14 and 18, although the provision of two light bar pairs enables additional data to be collected and therefore a greater number of measurements to be taken. Each light bar device should be positioned or arranged on the vertical uprights 12-18 so that it encompasses at least a substantial portion, and preferably the entire, range of motion of an exercise repetition. In other words, when the barbell exercise or repetition to be performed is carried out, the barbell 28 should pass through or interrupt a light beam 52 through the entire concentric (upward against gravity) and eccentric (downward with gravity) movement of the barbell. Together, the plurality of light emitters and detectors housed in such light bars create a light curtain through which a portion of the barbell must pass.

Figure 6:
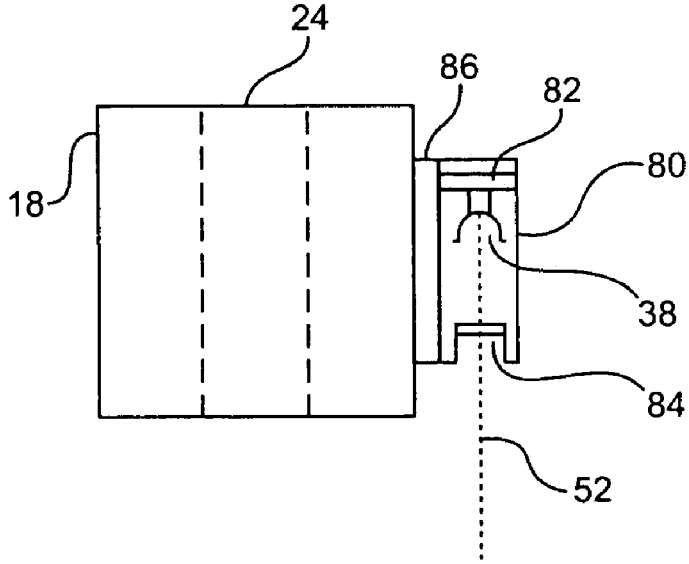
FIG. 6 is a top sectional view of the detector portion of the apparatus of the invention applied to an opposite corner post of a power rack.
Figure 7:
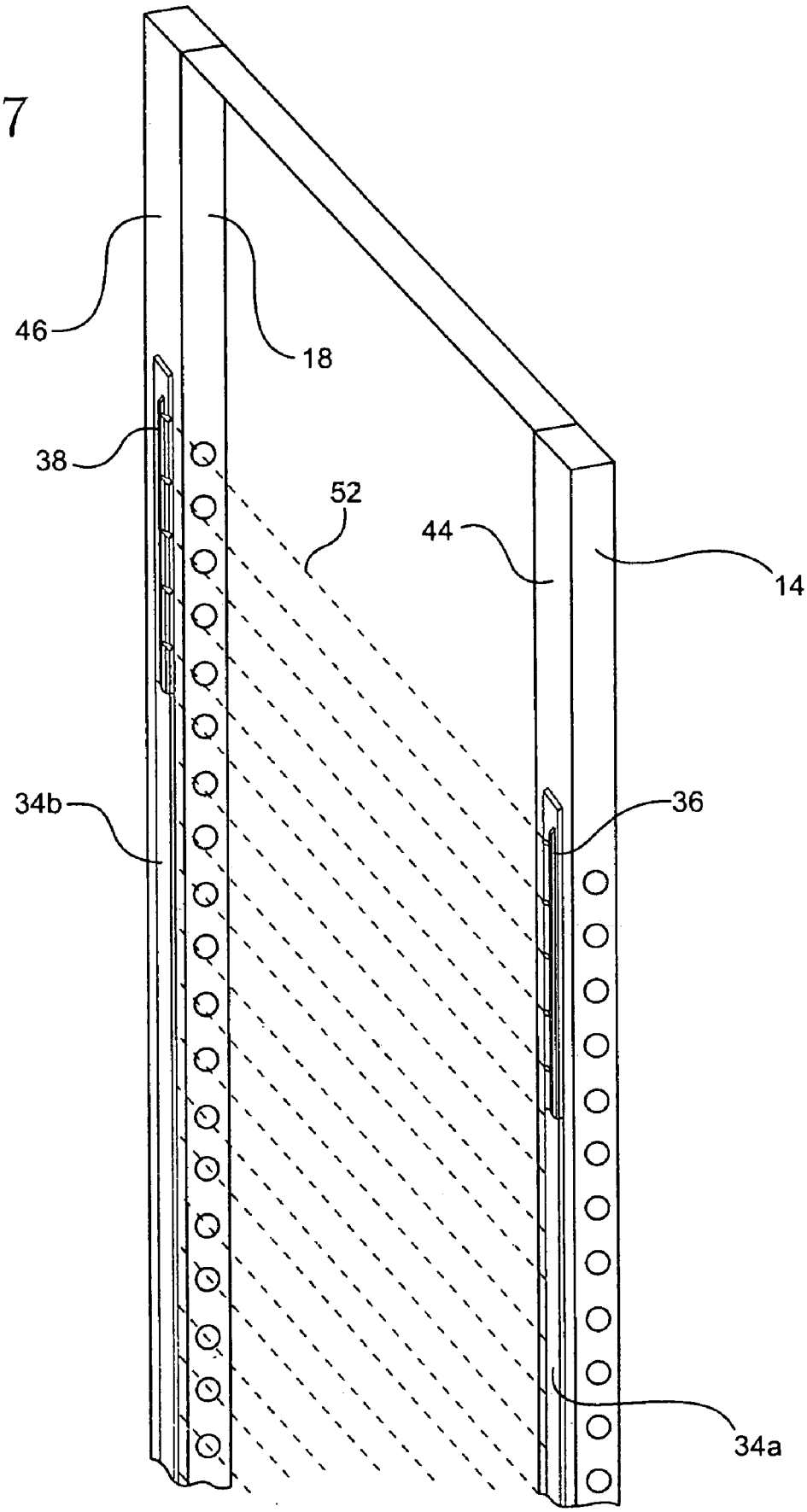
FIG. 7 is a diagrammatic oblique view of a portion of the emitter-detector arrangement of the invention on the corner posts of a power rack showing the series of electromagnetic radiation or light beams, represented by dashed lines, passing between the two, with a portion of the housings for the emitters and detectors cut away.
Figure 8:
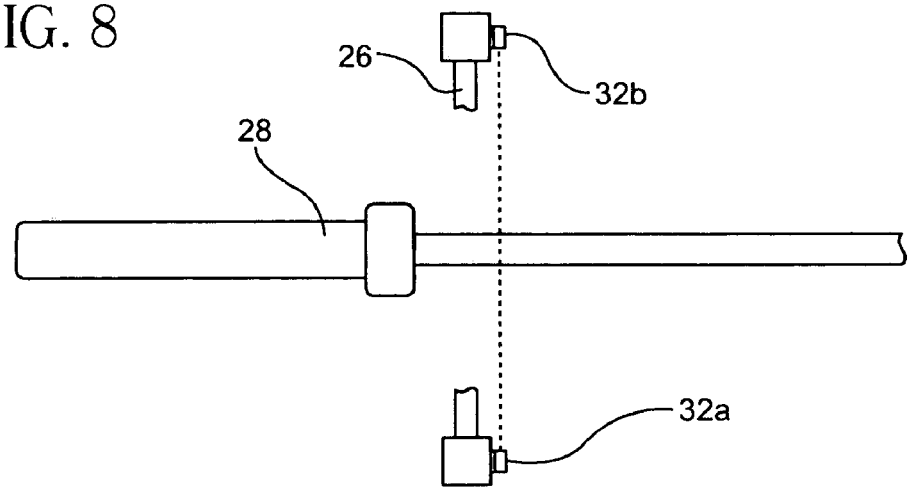
FIG. 8 is an enlarged upper view of a portion of FIG. 3 showing the end of the barbell (without a weight on the end) and illustrating how the electromagnetic beams intersect the handle or bar of such barbell.

Each light source or emitter 36, shown in FIG. 5, is suitably constructed to emit a brief beam of infrared light, while each light sensor 38, shown in FIG. 6, is a receiver or detector for the opposite emitter. The emitters are preferably pulsed in rapid individual sequences with its own detector so that adjacent detectors do not detect the pulse of adjacent emitters. Other types of sensor device arrangements may also be used, such as a photo-reflector arrangement or a diffuse style sensor arrangement wherein the sensor does not capture light but rather captures blocked signals. As described in more detail below, preferably, each light bar is constructed of a metal channel with closely spaced emitters, or alternatively detectors, provided along its back inside surface. The metal channel not only shields the emitters and detectors from external damage, but provides a unitary mounting for the entire unit.

FIG. 4 is a block diagram illustrating the basic electronic architecture of the exercise monitoring and data collection system 11 comprising the invention. A power supply 60 is electrically connected to plurality of light sources 36 housed in the light bars as well as to the remainder of the system 11. When a light pulse or beam 52 is emitted from light source 36, it is detected by light receivers or detectors 38. A signal provided by one or more of the detectors initiated by a detected light beam or pulse is transmitted to microprocessor 62. Over time, the detection or interruption of the light pulses emitted from various of the individual light sources 36 will be detected and recorded by each corresponding light sensor 38, all of which information is transmitted to microprocessor 62. Microprocessor 62 will interpret such information as indicating either the lack of presence or presence of barbell 28 passing through and blocking a particular light pulse during a given time interval. This information is also transmitted to an electronic database or memory storage device 64, which is used as an archive means for storing exercise parameter data so that it can be retrieved and used in the future when comparing past exercise performance with present exercise performance. Microprocessor 62 also may be programmed to calculate a wide range of exercise parameter data based on such recorded pulses or interruptions, such as the time in milliseconds (ms) of an exercise repetition, including both concentric and eccentric movements, as well as the acceleration, velocity, rest periods, and power exerted during certain portions of the repetition as calculated from the weight being moved and the velocity of such movement as well as any acceleration or deceleration.

In addition, the microprocessor 62 will be used to calculate other exercise data parameters, such as the range of motion of each concentric and eccentric repetition, and, if two light bar pairs are used as illustrated in FIGS. 2-3, whether barbell 28 is being held in a completely horizontal orientation during each repetition, or whether the barbell is leaning or inclined to one side so that one side of the barbell is being lifted slightly faster or ahead of the other side. This is accomplished by programming microprocessor 62 to compare the readings received from any pair of horizontally equal light source and detector devices on opposite uprights. If the detector indicates that the barbell 28 passed through or interrupted the light beam 52 of one emitter device 36 before it passes through or interrupts the corresponding light beam 52 of other emitter device, this will be indicative that the barbell is leaning to one side. The difference in time can be calculated and used to determine the speed of movement. This time difference, or difference in time at which the beam is interrupted, will be recorded by the detectors 38 and interpreted by microprocessor 62 so that it will provide the velocity of movement. If a difference in time is determined between the two sides of the apparatus for detectors at the same level, it will be evident that the barbell is leaning slightly to one side during such exercise repetition. The rapidity of such passage on each side may also be calculated to determine if such inclination is increasing or decreasing. An alarm indicating to the weightlifter such condition may be provided if desired, or possibly the display screen might flash a different color depending upon the direction of the lean. Time, velocity, and acceleration information may also be gathered and compared between different lifting sessions as a whole, different repetitions in a single session, or even between parts of a single repetition. The detail of the resulting data depends in large part on exactly how the light source and sensor devices are arranged or spaced in the light bars, as well as on the sheer number of light source and sensor devices. Obviously, the greater the number of light source and sensor devices, the smaller the intervals between the collected data, and the more precise such data will be at any given time.

It is important when setting up the measurement apparatus of the invention that the emitters of the detector couples, i.e. each comprised of a series of light emitters, usually of an LED type or the like, are aligned accurately with the detectors and that the height of these with respect to some base reference like the floor of the exercise area upon which the weightlifter is to perform or the height of a bench upon which the weightlifter will be supported will be known. Such measurements may be determined in any convenient manner such as by measurement with a tape, leveling with a bubble level extending between some representative portion of the detector couples such as the bottom or the like, laser leveling or the like. The apertures in the power rack corner posts may also be used as guides for placing the detectors, since they are already positioned or aligned vertically. The detector couples will, of course, be initially constructed so that the emitters and detectors are at exact locations with respect to the vertical extent of the linear length of the structure of such detector couples. As will be understood, it is not necessary for the emitters to emit visible light, as any form of fairly well defined or only slowly spreading or easily focused electromagnetic radiation may be used. Infrared light has been found to be particularly suitable for use with the present invention. In addition, as noted before, the activation of the individual emitters and detectors comprising a coupled pair may be staggered slightly in time with respect to other coupled pairs so that only the correct detector detects for each emitter and spread of the light or other electromagnetic radiation over the intervening space between detector couples does not result in the activation of other detectors above or below the coupled pair. A further possibility would be to provide staggered detector couples along the length of a detector strip so that adjacent emitters direct their beams of energy in different or opposite directions to different but coordinated detectors, in effect spacing the detectors at least one unit farther apart so that spread of the detection beam becomes less important. In such case, however, the emitters as well as detectors have to be better shielded with respect to electromagnetic radiation so detectors which are immediately adjacent emitters facing in the opposite direction are not activated, plus the wiring or circuitry is inevitably more complicated. Consequently, it is usually best to merely stagger the operation of adjacent detectors in one support or carrier with respect to time of activation.

The spacing of the individual detector couples up and down or along the detector couples has, as might perhaps be expected, a major effect upon the detail of the data collected. For example, if the distances of the detectors, one from the other, along a detector couple is 20 centimeters or approximately 8 inches, the accuracy of the data collected will be less than for an interval only 10 centimeters or approximately 4 inches. In particular, the accuracy and detail of data pertaining to relative rapidity of movement data with respect to any particular portion of the body will be decreased as the distance between adjacent detector beams is increased because the time between the weight bar cutting or occluding adjacent light beams of the so-called light curtain will be decreased. Of course, in order to have fairly accurate data collected with respect to movement of any particular portion of the body, such data will also have to be calculated based with respect to the bodily or anatomical dimensions of the exerciser. Thus a person of relatively short stature in a squat lift will have completed all leg movement earlier and at a lesser height than with respect to any further movement detected with respect to the overlap of a bar bell and a detector beam and will be with respect to the movement of the arms of the weightlifter. Consequently, it is advisable to enter the body dimensions of the particular weightlifter into the data system and correlate this with the height of the various detectors before beginning an analysis of the performance of the exercise, although such correlation is not strictly necessary. It has been found that it is generally preferable to have the detector beams spaced no farther apart than a range of two to five centimeters, a very effective distance being one centimeter or about one-half inch and preferably uniform along the length of the detector couples, i.e. from one detector beam to the other. In one embodiment, the inventor has provided ninety-six light emitters and detectors in the light bars, spaced apart every one-half inch, or slightly more than one centimeter apart, there being 2.54 centimeters in one inch linear measure. Further, the infrared light beams in such embodiment are emitted every 140 milliseconds, so that it is effectively impossible for the barbell to pass by the emitters between such intervals without being detected or interrupting several of the beams. Very little data is likely to be gathered by less than six consecutive electromagnetic beams and it will be understood that the closer to each other the beams are and the more numerous they are the more detailed information can be gathered, although in general the fewer beams are available the further away from each other they should usually be within a range of several feet in order to gather useful information except in special situations.

Referring still to FIG. 4, once microprocessor 62 has interpreted the pulse signals received (or interrupted) from each of the sensor devices 38, such output is transmitted to a video controller device 66, where it is converted for display on touch screen display 68. Alternatively, a non-touch display screen may be utilized wherein a keypad 70 may be used. By carefully reviewing and analyzing such data, the user can better pinpoint any problems or flaws in his or her lifting technique. For example, a user may determine that he or she is trying to lift too heavy a weight by analyzing the data and seeing that he or she is tiring quickly as indicated by rapidly increased time intervals of completion. The user can then modify his or her exercise routine, and furthermore can analyze the data again to see whether or not the modification has improved performance or whether or not further modification is required. The method of use of the present invention is described in further detail below with particular reference to FIGS. 16 and 17.

FIG. 5 is a close-up sectional view from the top of a light bar 36 according to the invention illustrating a preferred construction of the light bars provided with a light source and attached to front vertical upright 14, and FIG. 6 is a sectional view from the top of one of the sensor devices 38 attached to rear vertical upright 18. The light bar sections are both comprised of a lightweight aluminum housing 80 in which either a plurality of light source devices 36 or light sensors or detectors 38 are provided. Each light source device 36 is connected to an integral circuit board 82, with the circuits embedded in a bread board extending substantially the entire length of housing 80 and being of a type commonly used for such purposes. The typical positioning of the light source and detector devices 36 and 38 is further illustrated in FIG. 7, which is a side view of light bars 34*a-b* with the front section of the aluminum housing 80 partially broken away. See also FIG. 8, which further illustrates the relationship and positioning of light bars 34*a-b*. An opening 84 is provided in each housing 80, through which opening the light source and detector devices are both visible and exposed to each other, and which openings 80 are closed preferably with a Lexan™ plastic clear cover. As is evident in FIG. 5, light source 36 emits a light beam or pulse 52 that is aimed directly at light receiver or detector 38 as indicated by the broken sight line or electromagnetic beam which is imaginatively extended from the first emitter 36 in FIG. 5 to the detector shown in FIG. 6.

Figure 9:
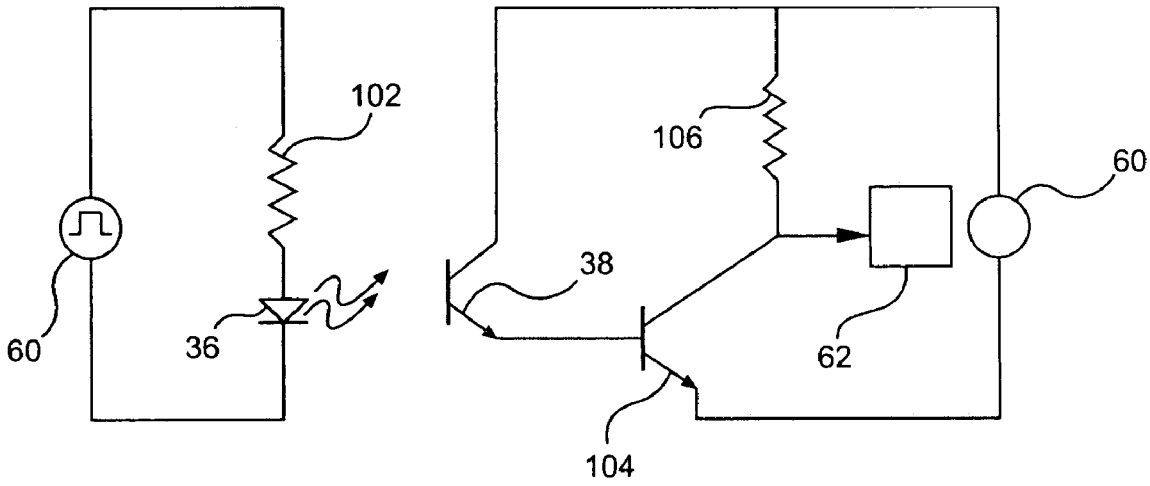
FIG. 9 is a diagram of the principal components of the electronic emitter and detector operation systems of the invention.

FIG. 9 is a circuit diagram illustrating a basic circuit for each of the light emitter and detector devices 36 and 38 used in the present invention. In the light source or emitter portion of the circuit, light emitting diodes are connected to a power source 60, with the circuit also including a resistor element 102. In the detector portion of the circuit for each detector device 38, the detectors are also operably connected to power source, with the circuit also including switching element 104, typically a transistor, and resistor element 106, while the pulses received by detectors 38 are sent or output to microprocessor 62 for further evaluation and conversion into meaningful information or data. The emitter and detector circuit are, of course, hinged upon each other as two physical separate circuits attached through light 52. Satisfactory emitter devices 36 are available from Optek, part number OP290A, and satisfactory detectors 38 are available from Fairchild Semiconductor, product number #QSE156. It should be understood that various other emitter and detector devices having similar properties are suitable and may be used alternatively with the above exemplary devices.

Figure 10:
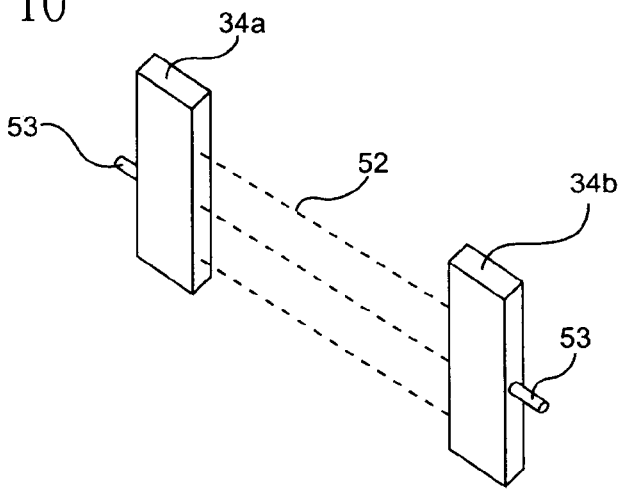
FIG. 10 is a semi-diagrammatic view of an alternative arrangement for mounting the detector couples on a power rack.

In an alternative and less preferred embodiment, shown in FIG. 10, the light bars such as those labeled 32*a-b* and 34*a-b* above housing emitters 36 and detectors 38 further include a pin 53 similar to the one on collar 26 shown in FIGS. 1 and 2 which fits in and extends through apertures 24 in the vertical uprights of power rack 10. Magnets may also be provided with the embodiment shown in FIG. 10 to aid in keeping the pins in the power rack orifices, although they are not absolutely necessary. Such pins 53 are useful when the sensor devices are to be connected to a device such as power rack 10 having spaced apertures 24, which is customary since spotting bars are normally extended through such orifices as a safety measure. If the sensors are positioned directly over or in front of apertures 24, it will be easier to align the emitter portion 36 and receiver or detector portion 38 of the sensors. In addition, since apertures 24 are normally disposed at a known distance apart, attaching the sensors in such apertures would take advantage of such known distance, which distance is important in calculating average speed, velocity, power and the like between sensors. However, mounting the emitters and sensors in or over the apertures has the disadvantage of blocking certain orifices from accommodating spotter bars and also will cause a break in the sequence of light sources and detectors, decreasing the accuracy of data collected. Since the spotter bar orifices furthermore are by necessity rather large in order accommodate sturdy spotter bars, if the detectors and light sources are individually mounted in or in conjunction with such orifices, the sensitivity of the sensor system is significantly decreased. On the other hand, if the orifices are merely used to mount a series of detectors or the like in a short series such interference may not be as serious. However, as will be understood, the arrangement shown in FIGS. 2 and 3 is much preferred. Where the sensors are to be mounted on a surface that does not have such spaced apart holes, the magnetic holders would of course be preferred. In either case, the sensors may be set up and be ready for use within a few minutes, which is a significant advantage in a public exercise environment, where there may be several individuals waiting to use a particular piece of exercise equipment, particularly one such as a power rack, where each user may undertake several sets of five to fifteen or more repetitions of an exercise. In addition, many times one may have only a limited amount of time available to complete a workout regimen, so that it would be impractical to spend a large amount of time setting up or retrofitting a data collection system to a machine, such as would be taken in individually mounting detectors or detector strips in individual orifices in a power rack.

Figure 15:
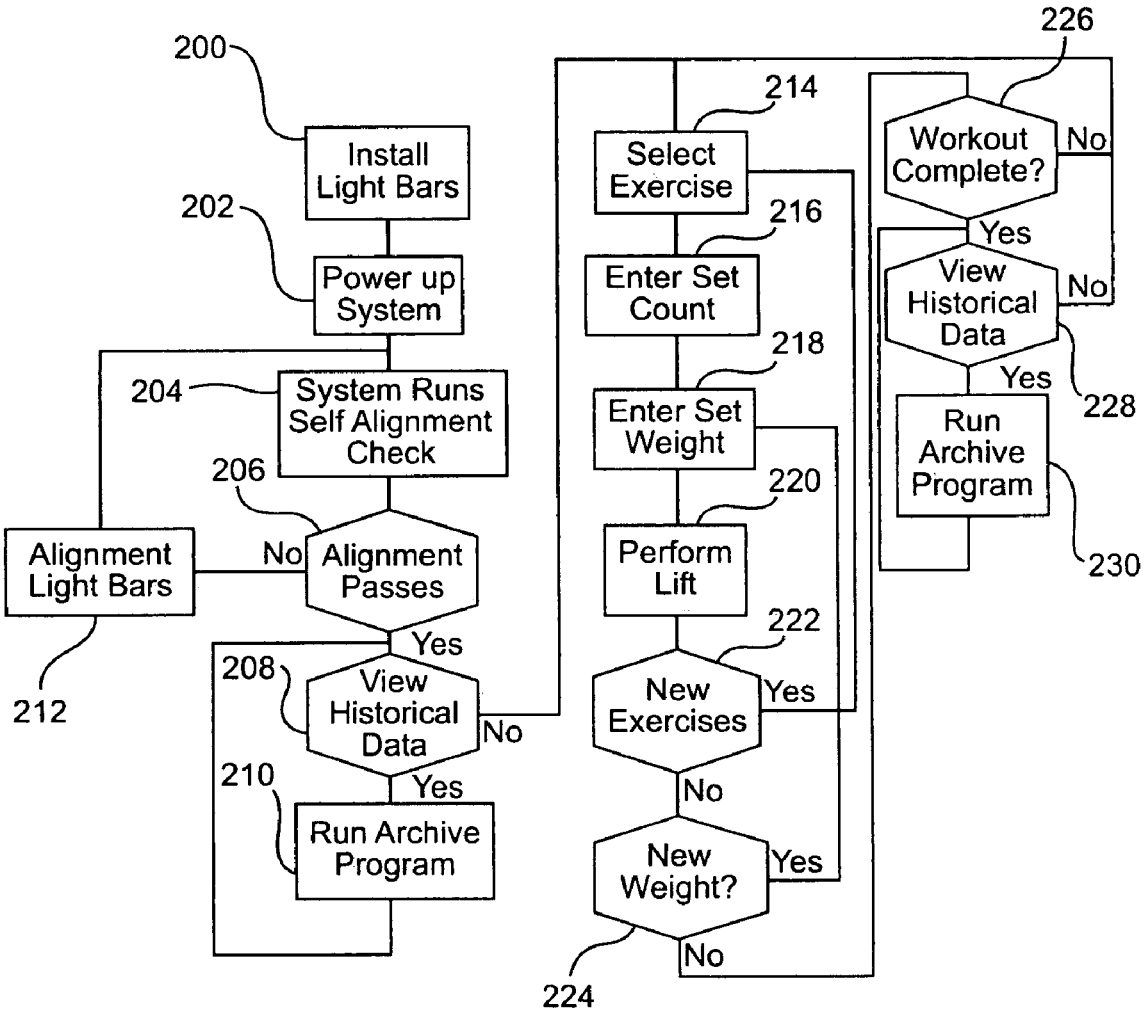
FIG. 15 is a flowchart outlining the basic steps in setting up and using the exercise feedback apparatus and system of the invention.

FIG. 9 is, as noted above, a basic circuit diagram for each of the emitter devices 36 and for each of the sensor devices 38, whereby signals are then communicated to and processed within the microprocessor to result in a signal which corresponds to data such as the power, velocity, and acceleration at certain times during the exercise repetition process. FIG. 15, discussed in more detail below, is furthermore a flow chart illustrating the flow of data from the electronic pulses generated by the sensor devices into the microprocessor, where the pulses are analyzed and converted into useful data. The resulting data is then used by the microprocessor in conjunction with pre-programmed data to calculate velocity, acceleration, power, and the like. Such data is then displayed on the user interface device, or alternatively such information may be printed, emailed, stored on a disk in a computerized format, converted into an audio signal, or otherwise displayed in a manner which is preferred by the user.

Figure 11:
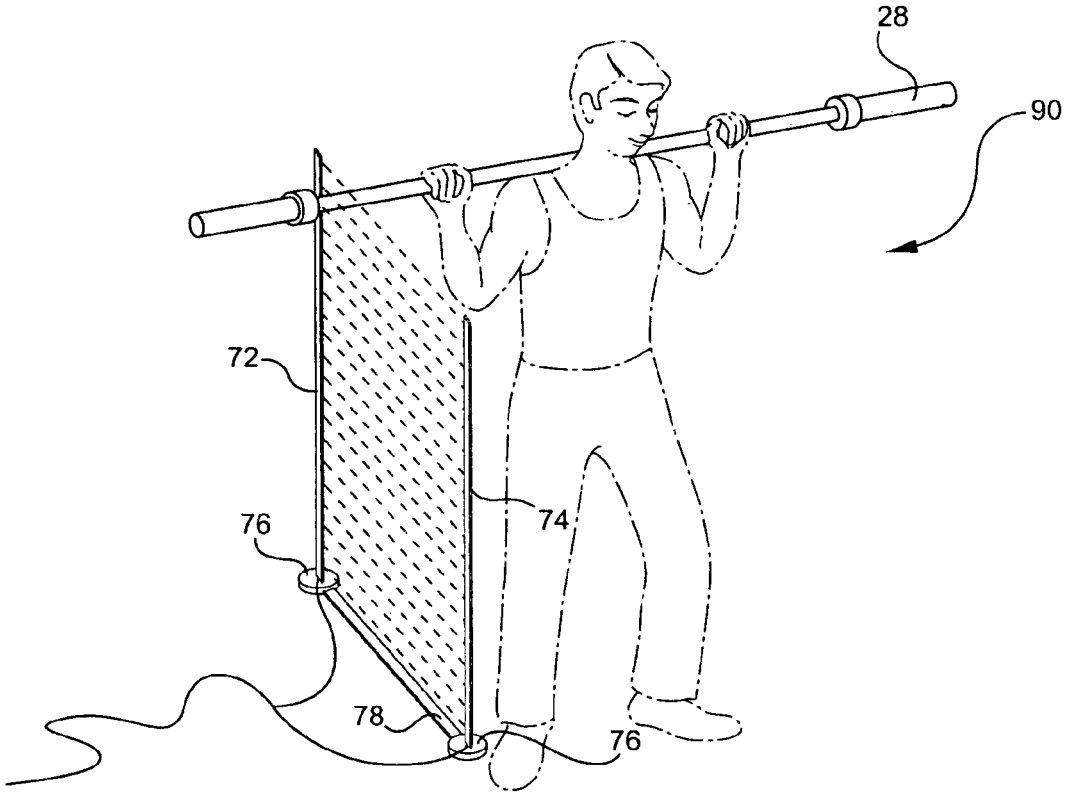
FIG. 11 is a view another alternative arrangement wherein the detector couples are designed to be freestanding rather than attached to a power rack and also illustrating use of detector couples on only one side of a weightlifting arrangement.
Figure 12:
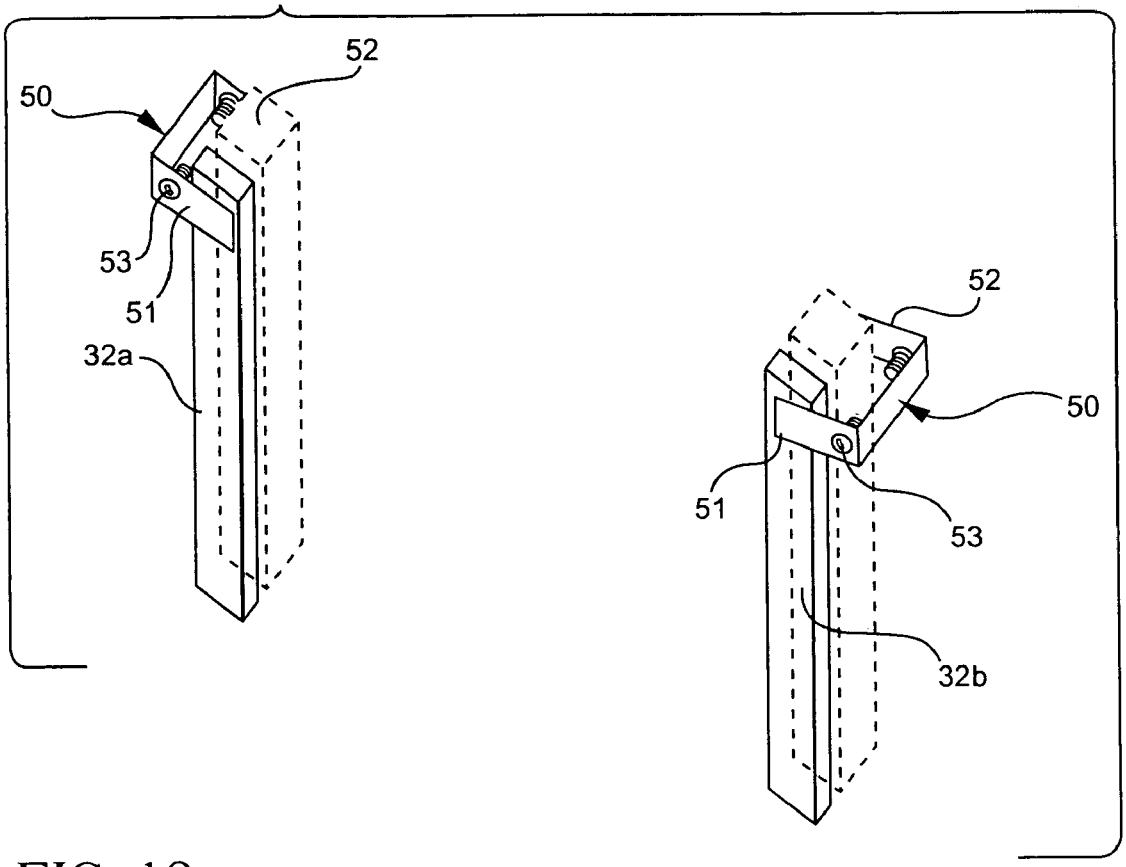
FIG. 12 is an enlarged view of an end of a light curtain strip used in the invention showing a clamp which is used to secure the light curtain strip to a vertical member of a power rack.

FIG. 11 illustrates another convenient embodiment of the invention wherein rather than having the light bars attached to an existing framework such as power rack 11, such as shown in FIG. 2, the light bars are provided in a freestanding arrangement. More particularly, emitter and detector light bar sections 72 and 74, which are substantially identical in construction to those described above with reference to FIGS. 2-9 having a plurality of spaced apart vertically aligned emitter devices 36 and a plurality of corresponding spaced apart vertically aligned receiver devices 38, are further being supported in an upright position on base or leg members 76. The freestanding light bar sections 72 and 74 may be positioned next to a bench press, not shown, a power rack or other apparatus upon which a barbell 28 or dumbbells may be supported ready for use, or even adjacent one lifting a barbell or dumbbell in a free-weight fashion. In particular, the end of barbell 28 extends through the light curtain created by the detector couple, so that as the barbell is moved in an up and down or concentric and eccentric motion, it will momentarily block or interrupt the light beams, which interruption will be recorded in the manner described above. Only one detector couple is shown in FIG. 11, which will provide adequate data except it will not detect side inclination of the barbell. If preferred, a second detector couple could be positioned along the opposite end of the barbell 28. The vertically elongated pieces 72 and 74 may also be provided with magnetic means and retractable or removable feet so that they may be converted to use directly on a power rack or the like for support lending versatility to the apparatus.

FIG. 11 described above basically illustrates another preferred embodiment of the data collection system 11 of the present invention wherein the sensor devices are provided on separate light bars or framework pieces 72 and 74 similar to those shown in FIG. 2, but wherein rather than attaching such framework pieces to a vertical surface, framework pieces 72 and 74 are provided with a separate base or leg structure 76 so that such pieces are freestanding. A bar 78 connecting pieces 72 and 74 preferably is provided to aid in ensuring that the emitter and detector portions of the sensor devices are aligned properly, although such connection piece is not necessarily critical to the operation of the invention. Note that the framework pieces 72 and 74 are arranged so that the emitter and detector portions of the plurality of sensor devices are pointing towards one another and so that the light curtain 40 created by such sensor devices will be directly in the path of the barbell when it is raised and lowered in performing a bench press exercise or the like. Separate framework pieces could be provided on opposite sides of a barbell used on an exercise bench or other exercise apparatus if desired. As illustrated by FIG. 11, providing the framework pieces with legs enables them to be used in a wider variety of settings whereby they merely have to be placed strategically in the path of a performance of a free weight exercise movement.

FIG. 12 shows an alternative arrangement for connecting the light bar sections 32*a* and 32*b* to a pair of vertical uprights such as shown in FIG. 2. While in FIG. 2 magnets are used, here the ends of a detector couple pair are attached to the vertical uprights using U-shaped clamps 50. One leg 51 of the clamp will be placed over the outer side surface of the light bar housing 80, while the other leg 52 is placed over either the inner or outer surface of the vertical upright, depending on the position of the light bar. The clamp is then tightened such as by threaded tightener 53, and the housings 80 are secured in place. While not shown in FIG. 12, it will be understood that there will be another pair of clamps 50 at the bottom of the light strip. If necessary, additional clamps could be applied intermediate of the ends. It is preferable that the one side of the clamps 50 be attached permanently to the light bar units or strips but merely as a matter of convenience in positioning the units.

Figure 13:
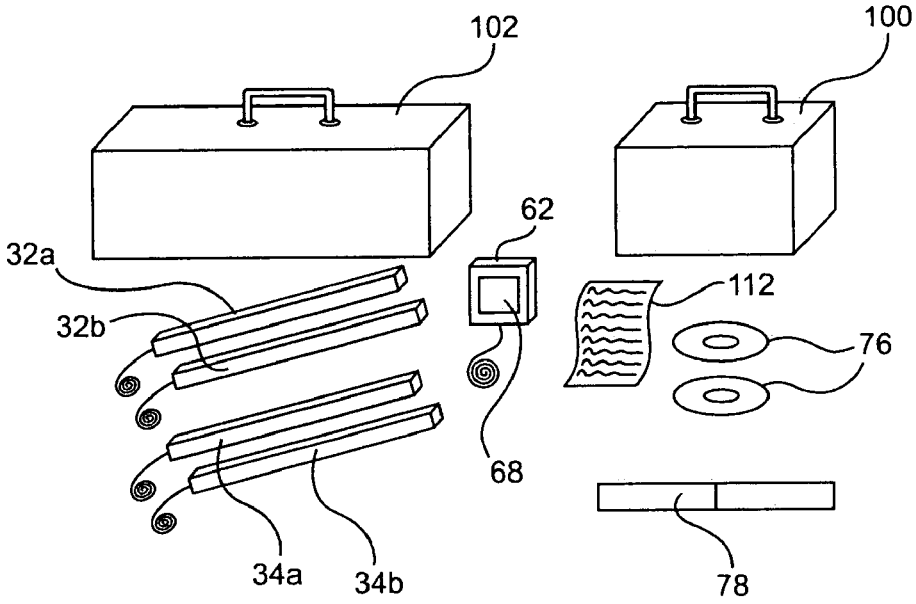
FIG. 13 is a view of the major components of the portable and/or retrofittable apparatus of the invention disassembled and ready to be placed in a carrying case.

FIG. 13 is a view of the detector couple apparatus and the electronic components broken down for personal transportation to a gym environment, plus two carrying cases for transportation of such equipment. More particularly, a rectangular case 100 for the receipt of the electronic device or apparatus, including display 62, and an elongated narrow case 102 for containing the detector couples 32*a-b* and 34*a-b* themselves are provided. The detector couples may also be made in separate pieces that fit together into an integrated elongated section in which all the emitters and detectors are when fitted together automatically at the correct intervals from each other. Foot or base members 76 as well as connecting member 78 may also be provided to give the user the option of setting up the detector couples in a freestanding arrangement in addition to attaching them to the corner posts of a power rack or the like. Directions 112 for setting up and operating the exercise feedback system 11 will also typically be included.

Figure 14A:
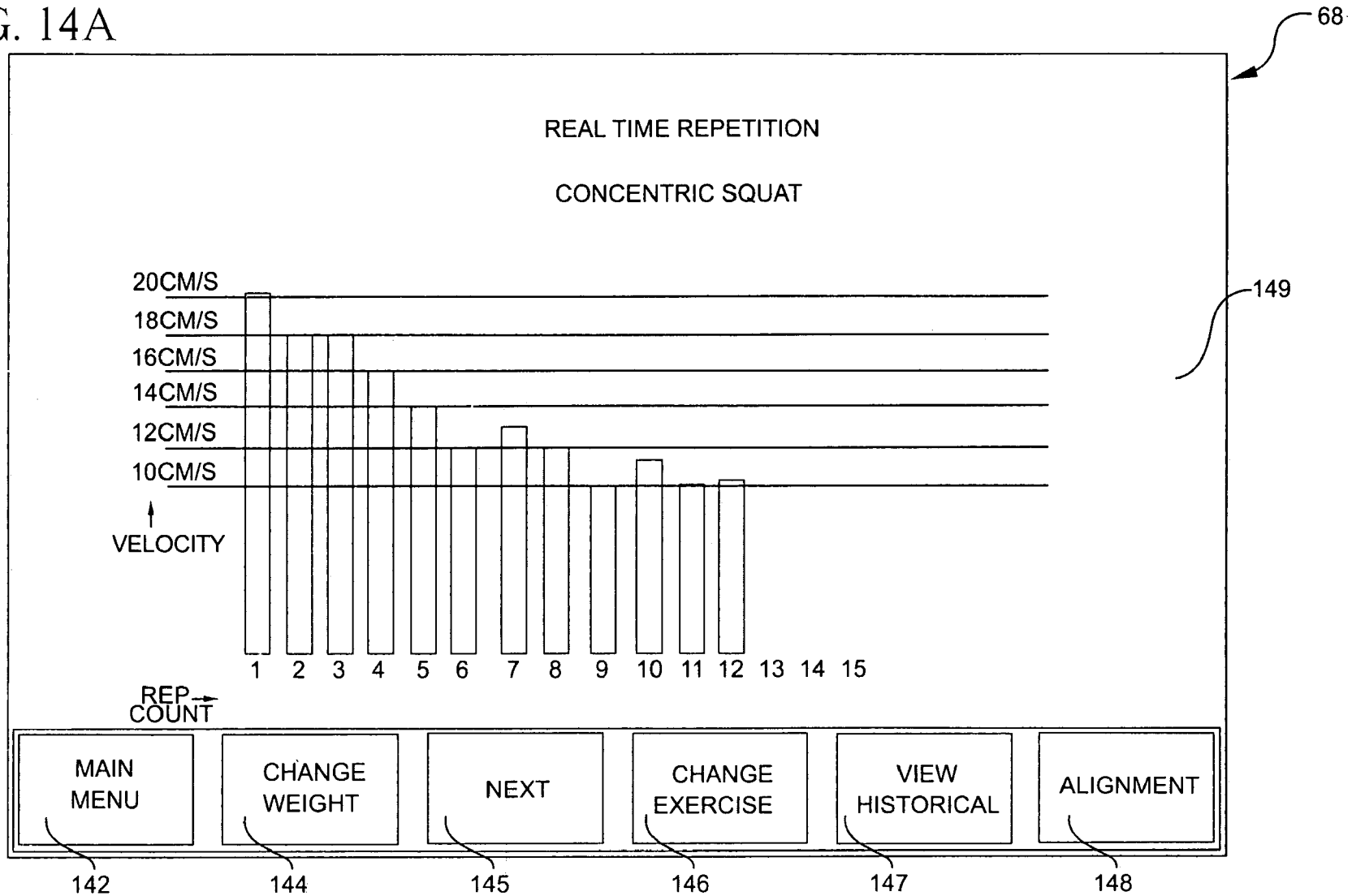
FIGS. 14*a*-14*e* illustrate typical displays of information detected and compiled by the apparatus of the invention.
Figure 14B:
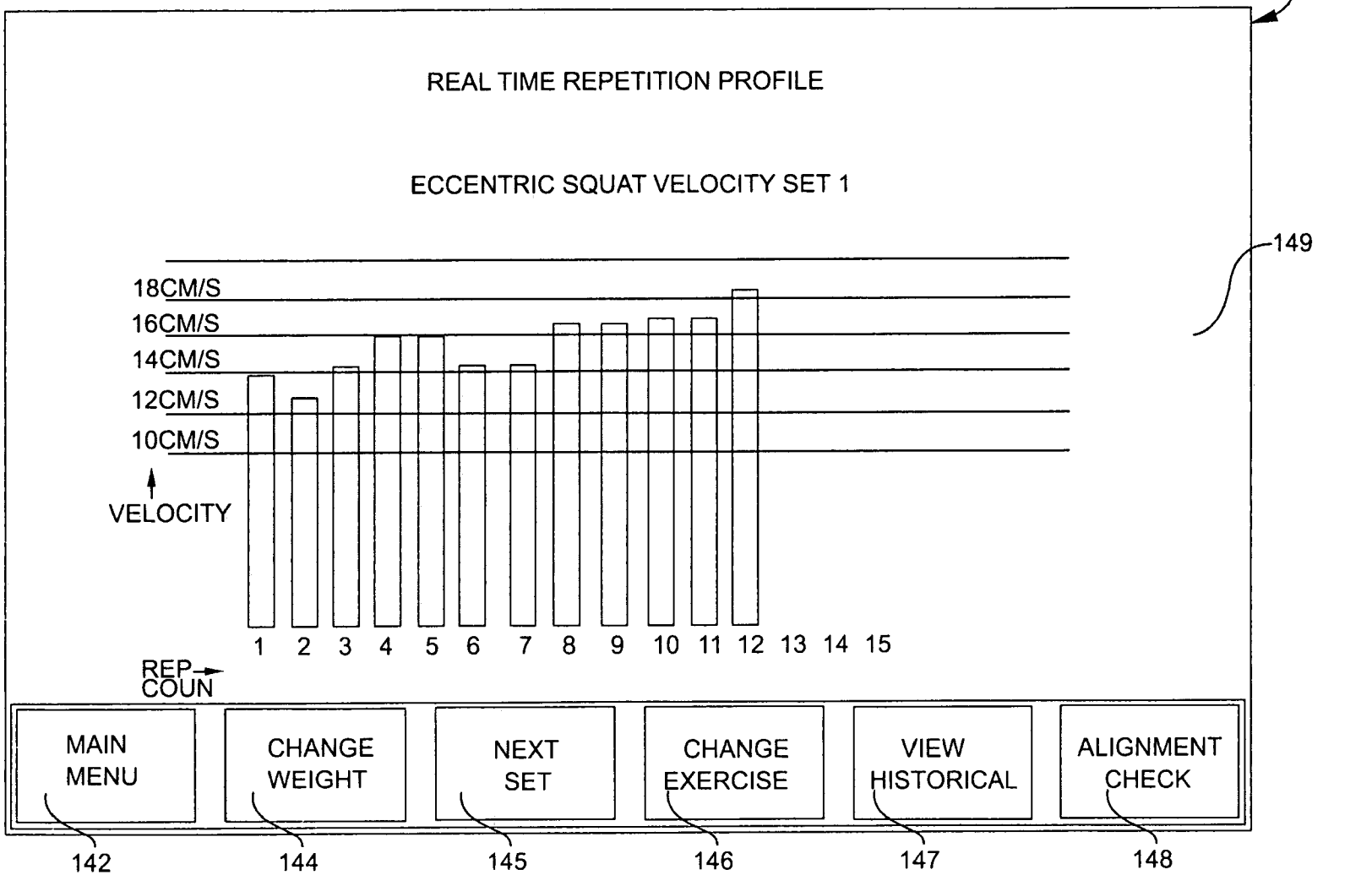
Figure 14C:
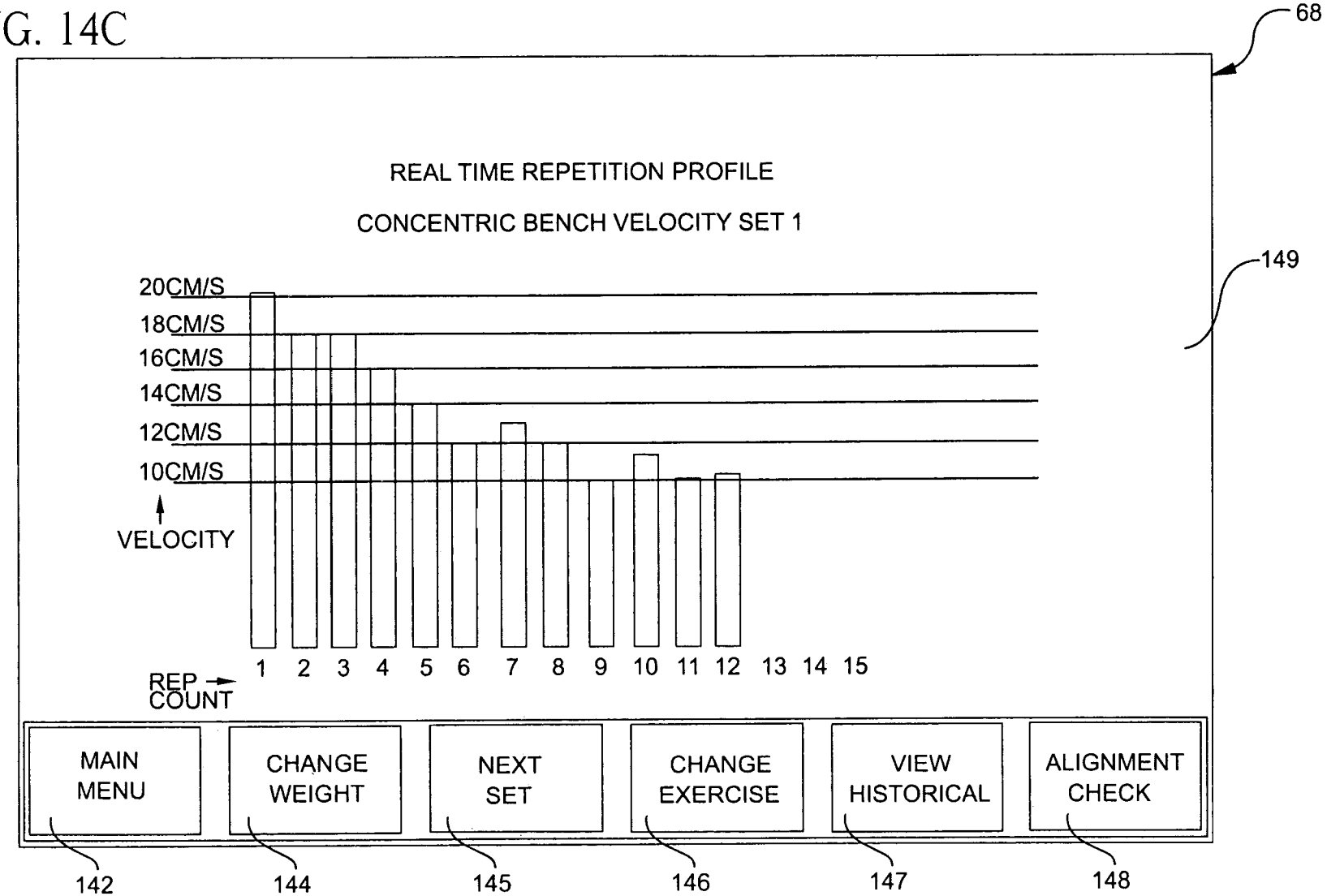
Figure 14D:
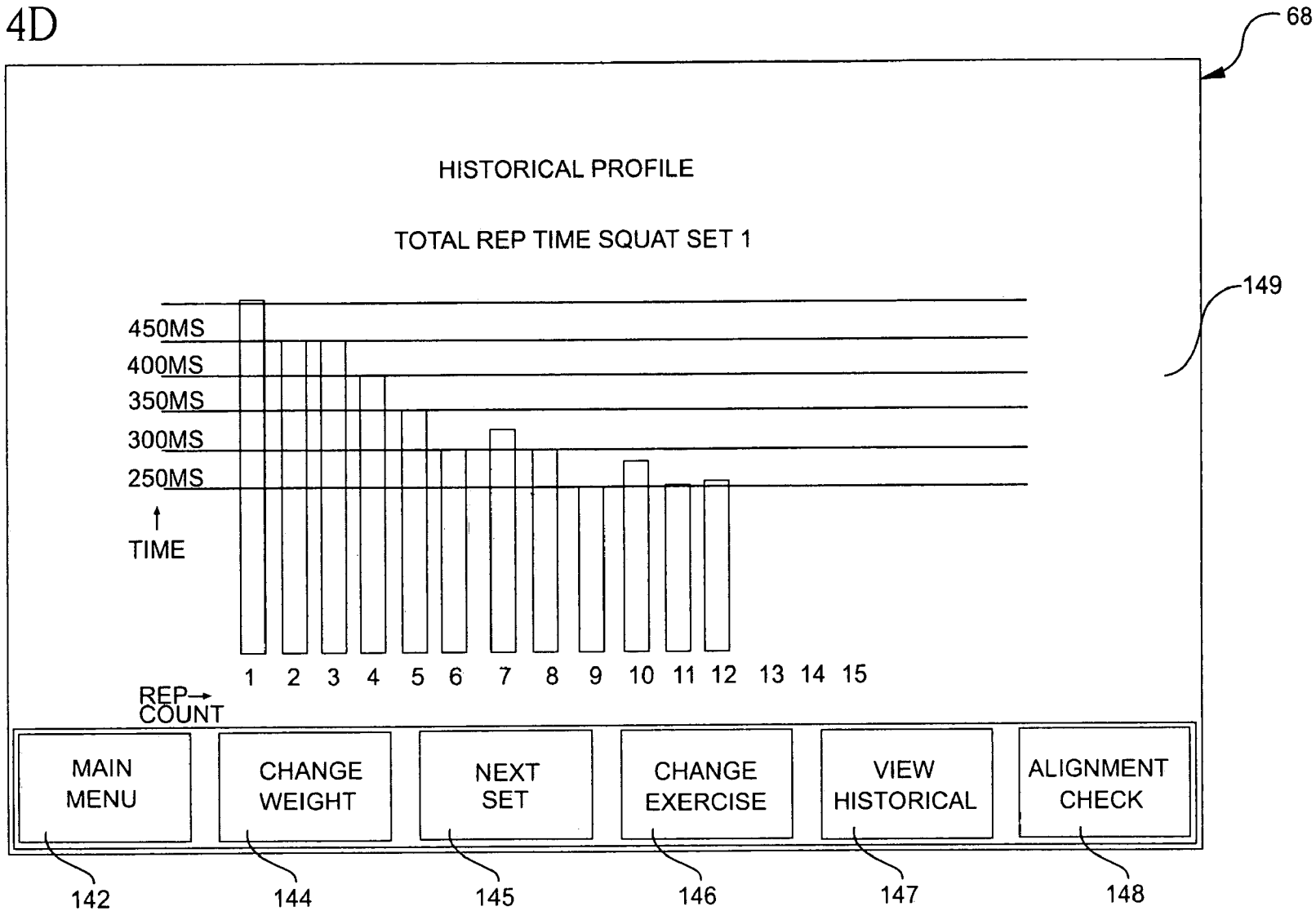
Figure 14E:
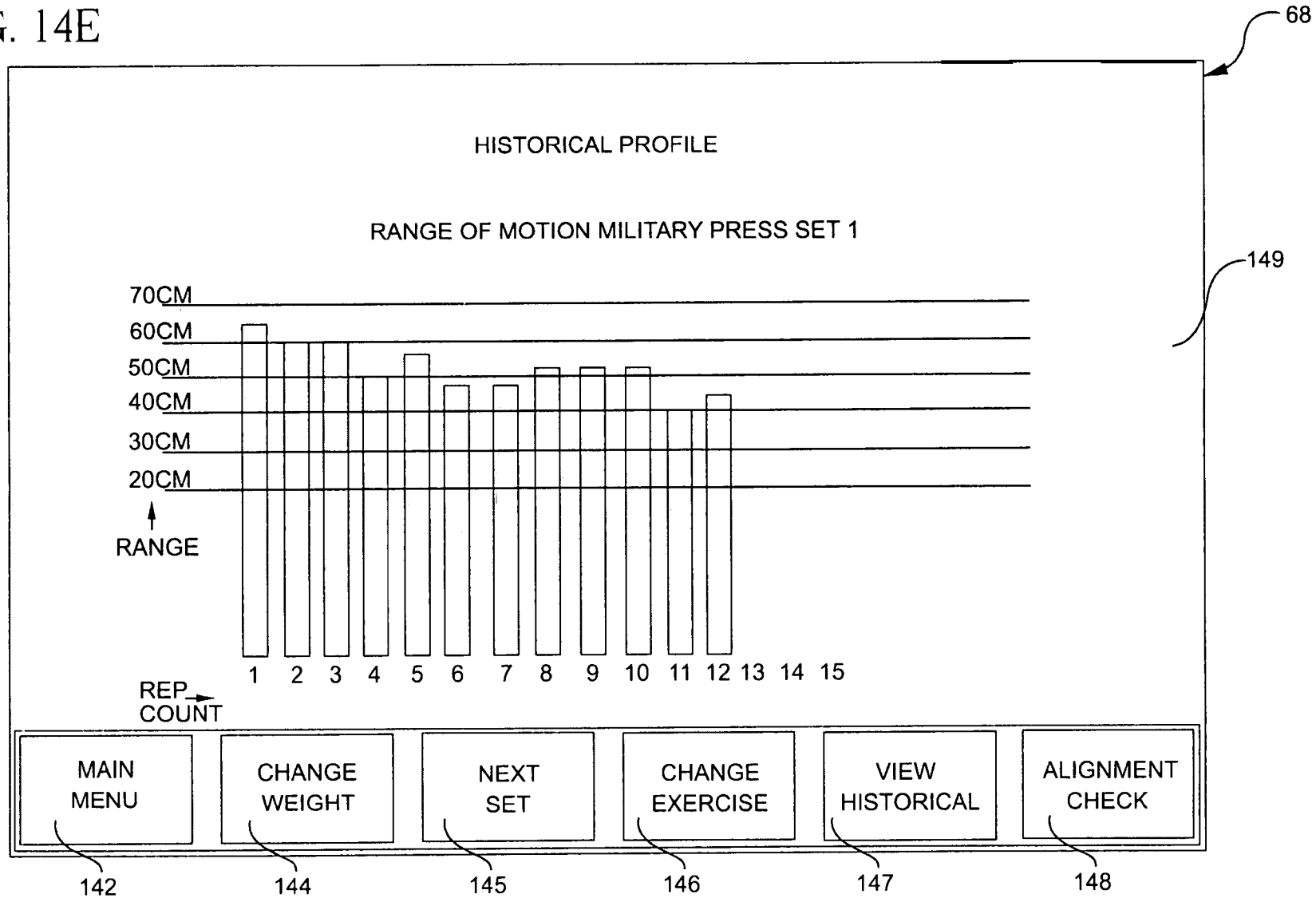

FIGS. 14*a-e* are screenshots of the electronic monitor display screen 68 displaying exercise data or information in graphic form. Each display 68 includes six standard buttons indicated in FIG. 14*a* as "Main Menu" 142, "Change Weight" 144, "Next Set" 145, "Change Exercise" 146, "View Historical" 147, and "Alignment Check" 148, as well as a graphical display area 149. In FIG. 14*a*, the velocity of each repetition of a concentric squat motion in a set is graphically displayed in bar format, with velocity corresponding to the vertical axis and number of repetitions corresponding to the vertical axis, while in FIG. 14*b* the velocity of each repetition of an eccentric squat motion in a set is similarly displayed. In FIG. 14*a*, the velocity in general of successive concentric repetition decreases over time, while in FIG. 14*b* the velocity in general of successive repetitions increases over time. This result although merely exemplary is not unexpected, since as the weightlifter tires, he or she will likely move downwardly somewhat faster and upwardly somewhat slower with each repetition. Similarly, in FIG. 14*c* the velocity of each repetition of a concentric motion in a bench press exercise is displayed decreasing over time. In FIG. 14*d* the total repetition time of each repetition in a set of squat exercises is displayed, and in FIG. 14*e* the range of motion profile of each repetition of a set of military presses is displayed. FIGS. 14*a-e* are exemplary of the various data that can be calculated and output to an exerciser using the data collection system and method of the present invention, and it should be understood that such data can be provided in table form, chart form, or in any other suitable format.

FIG. 15 is a flowchart of the steps in setting up and using the data collection system and method of the present invention. First, the user will install the light bars 32*a-b* and 34*a-b* to the side surfaces of the corner posts (Step 200) of the frame apparatus or power rack 10, using either the magnets 86 as shown in FIGS. 5 and 6, or the clamps shown in FIG. 12. Care should be taken to ensure that the bars are set at the same height on the posts. The bars will then be hooked up to the microprocessor via either a hard wired or wireless (see FIG. 17) connection. Next, the system may be turned on (Step 202), after which the system will automatically run an alignment check (Steps 204 and 206) to make sure that the light bars are aligned properly. If the bars are not properly aligned, the system will prompt the user to re-align the bars until they are aligned properly (Step 212). Once the bars have been properly aligned and pass the alignment check, the user can choose whether or not he or she wishes to view historical data (Step 208), whereby an archive program can be selected and run (Step 210). The option allows the user to easily track his or her performance and measure it against past performances. Next, the user will select an exercise to be performed from a list of preprogrammed exercises (Step 214), or program a new exercise if the user has not previously performed such exercise. If an existing exercise is selected, the user will then be prompted to enter further information about the exercise, including the set count (Step 216) and the set weight or weight to be lifted (Step 218). Next, the user will perform the exercise or lift (Step 220), whereby the light bars 32*a-b* and 34*a-b* will detect such lift and record the movements of the barbell. After the lift is completed, the user can either enter a new exercise (Step 222) and repeat Steps 214-220, or enter a new weight (Step 224) and perform another set of the same exercise. Such steps are repeated until the user has completed his or her workout (Step 226), whereby the user can then view the data collected with respect to such exercises (Step 228) as well as review archived or historical data and compare it to the new data (Step 230). The power supply for the system may then be turned off, or the user may simply log off the system if an initial login was required, whereby the system will be ready for use by another weightlifter.

Figure 16:
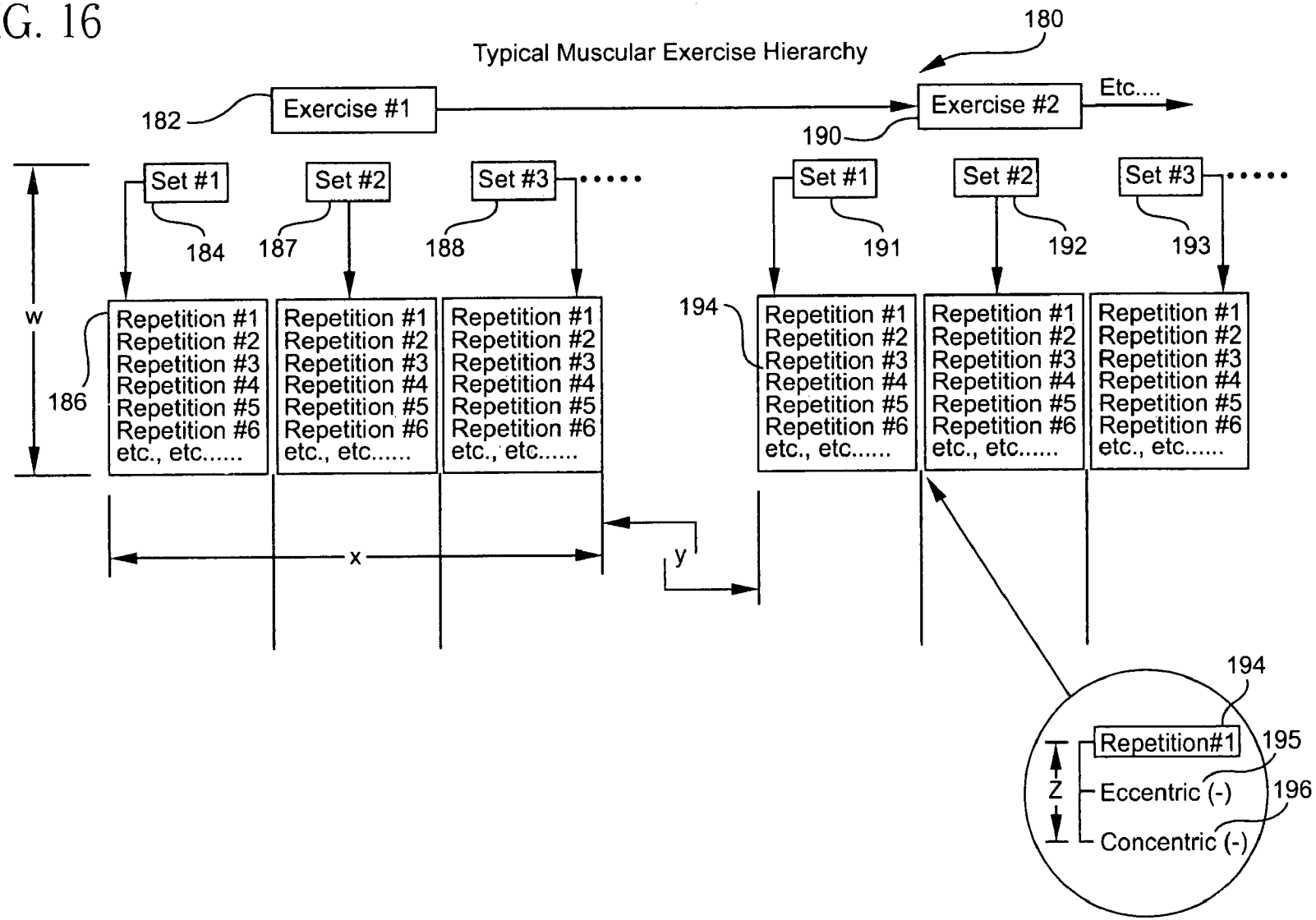
FIG. 16 is a representation of a typical muscular exercise hierarchy or routine that might be performed in connection with the exercise feedback apparatus and system of the invention.
Figure 17:
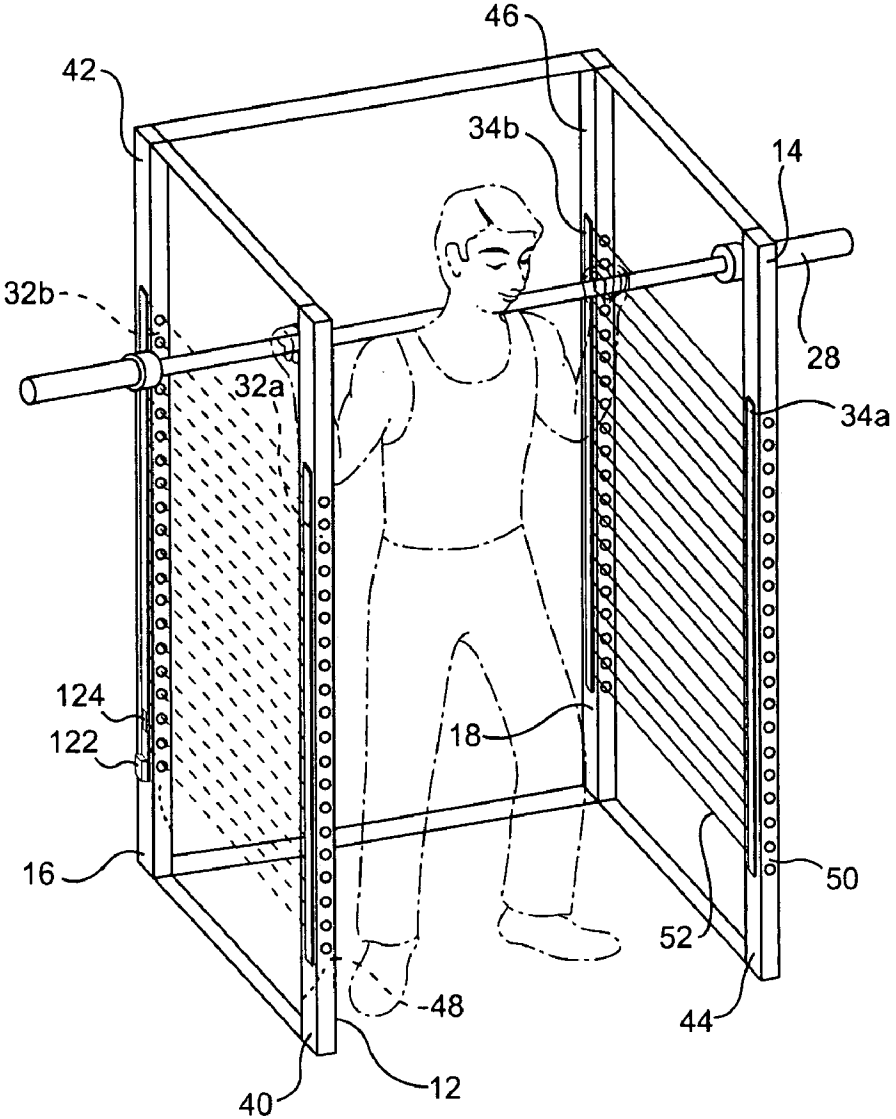
FIG. 17 is an isometric view of an alternative embodiment of the invention wherein the exercise feedback apparatus and system of the invention includes a wireless connection between the emitter and detection devices and the microprocessor.
Figure 17:
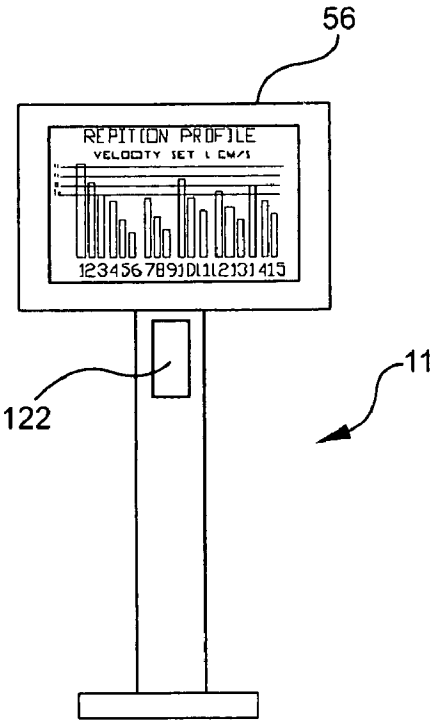

FIG. 16 is a hierarchical chart illustrating a typical or sample exercise regimen 180 which further illustrates some of the possible exercise routines and the data that can be obtained from such routines. After the data collection system has been set up and aligned properly as outlined in Steps 200-212 in FIG. 15, the user will select a first exercise 182 and perform a first set 184 which will include a number of repetitions 186. After a brief rest period, the user will perform a second set 187, a third set 188, and so on. The time spent performing each of the individual sets, indicated by the letter "W", as well as the total time required to complete all of the sets, including rest periods, indicated by the letter "X", may both be calculated. After the first exercise is completed, a second exercise 190 including sets 191, 192, and 193, etc. may be performed, as well as a third exercise, a fourth exercise, and so on. The rest period between exercises, indicated by the letter "Y", may also be calculated. Furthermore, detailed data with respect to performance of each individual repetition 194, such as the individual eccentric 195 and concentric motions 196, may also be calculated. As indicated above, the inventor has provided in the preferred embodiment a total of ninety-six emitter and detector devices in each light bar pair, so that every half inch the bar will pass through another light beam an measurements will be taken. Thus, in performing, for example, three sets of an exercise, with each set containing ten repetitions, it would not be uncommon for at least fifty measurements to be taken with each eccentric and concentric motion in each repetition. This means that over one hundred measurements would be taken for each repetition, or over one thousand for each set perform, or over three thousand if three sets are performed. Furthermore, if two light bar pairs are provided as shown in FIG. 2, such number of measurements will be automatically doubled. As is clearly evident, the number of measurements is limited only by the range of motion of the exercise, as well as the closeness of the emitter and detector devices, and therefore that the above example is not meant to limit the scope of the invention in any manner.

While the present invention has been shown and discussed above primarily including a hardwired electrical connection between the sensor devices and the microprocessor and display terminal, as shown in FIG. 17, in another preferred embodiment of the invention, there is a wireless connection between such sensor devices and the microprocessor. A wireless transmitter 120 will be provided for the sensor devices 38 in light bar sections 32*b* and 34*b*, while a wireless receiver 122 capable of communication with transmitters 120 will be operably attached to microprocessor 56. Battery pack 124 for powering transmitters 120 will also be provided. The transmitters 120 and battery packs 124 may be embedded in housings 80, or alternatively may be connected externally to such housings or even provided in the corner posts with separate small holes drilled in the posts adjacent the pin apertures. The use of a wireless connection between the sensor devices and microprocessor is desirable in many respects, particularly because it eliminates the wire connection which could be a tripping hazard to a weightlifter or bystander. In addition, the wireless connection may be easier to set up then the hardwired arrangement, and therefore may be more desirable in a portable system. The technology for creating a wireless connection is well known to those skilled in the art and therefore it is not only requires any further explanation. A wireless connection may also be provided in the freestanding version of the invention, shown in FIG. 11.

As indicated above, the preferred arrangement for the light emitters and the detectors are in separate sturdy channel members which may be attached in any convenient manner to the sides of vertical support members of a power rack preferably by magnetic means. Since the emitters and detectors are spaced opposite to each other in the channel member, as long as one point on such channels such as the top or bottom is leveled with the other, all the detectors and emitters will then be lined up with each other, making them easy to install correctly. If it is desired to shorten the length of the individual emitter strips, they can be formed of individual straps or units that can be fitted together.

The inventor has now further developed the same technology utilized in the exercise motion detection and monitoring apparatus of the present invention as described above, wherein pairs of light emitters and detectors are housed in separate channel members and spaced opposite each other on the vertical uprights of a power rack or the like, to be used in a manner by which the number of channel members or beam bar devices can be reduced to a single beam bar device used in the same manner as has already been described but containing both the beam emitters and detectors in the same bar device. This arrangement is advantageous in that the number of components and cost of the system is reduced, and in addition the time required to set up the system and apparatus is minimized. In addition, as is illustrated below, the improved device is more versatile and capable of being used in a greater number of different possible arrangements, such as with half rack systems having only two vertical posts, as opposed to the conventional power rack and Smith machine which have four posts, or secured in a horizontal rather than vertical plane, such as to the vertical spotter bars of a power rack or half rack.

Figure 18:
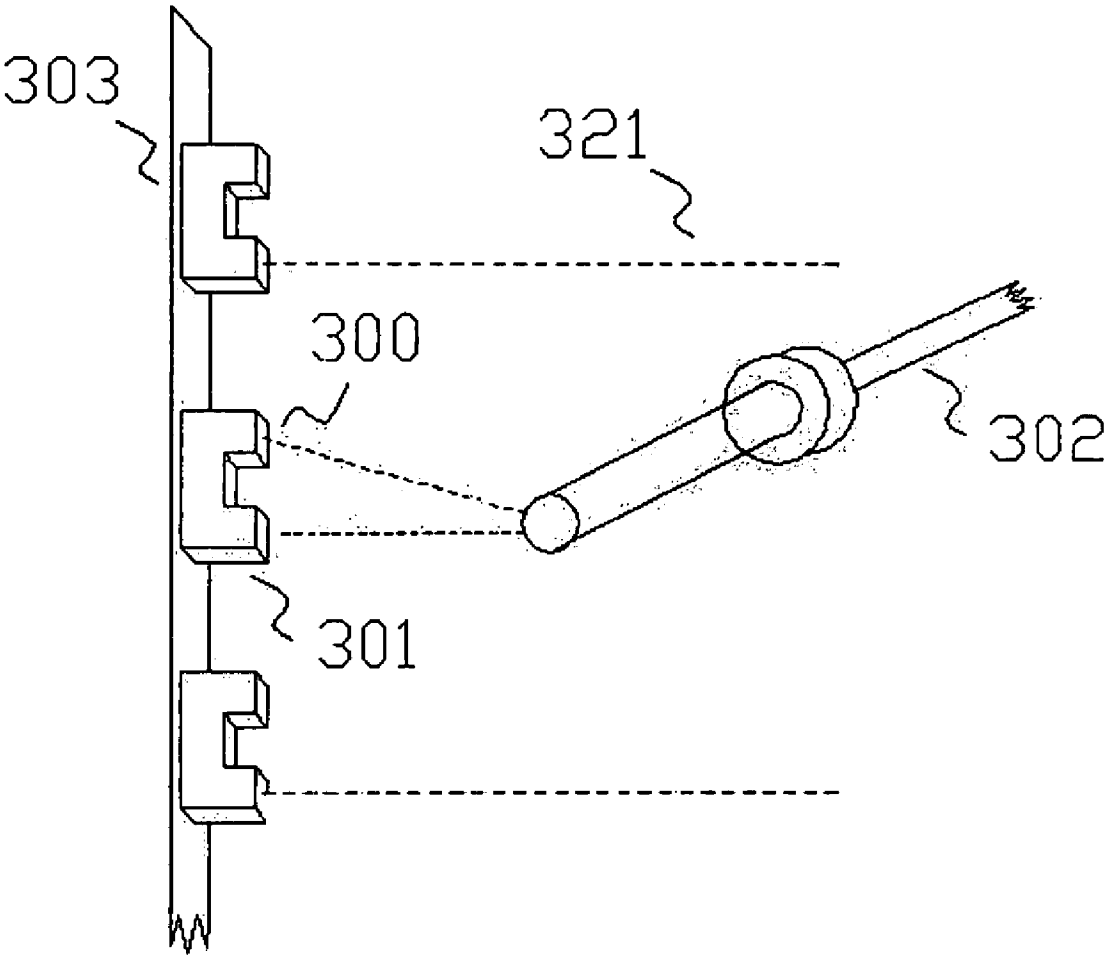
FIG. 18 is a side sectional view of an alternative embodiment of the apparatus of the invention wherein the emitter and detector portions are applied to the same corner post of a power rack, half rack or supported by a tripod stand on a platform, with the light beams indicated by dotted lines which are received by the detectors when a barbell reflects the light beams back to them.

FIG. 18 is a diagrammatic sectional view of light emitting and detecting device 303, also referred to herein as light bar 303, with the channel covering removed to show the position of the pairs of associated light emitters 301 and detectors 300, and the typical vertical position of a barbell 302 as it passes through the light curtain created by the plurality of beams of light 321 emitted from device 303. Light emitter and detector device 303 is similar in construction to the previous embodiments discussed above, except pairs of alternating light source or emitting units 301 and corresponding light detector units 300 are arranged side-by-side in a row in the same housing, rather than with the emitters and detectors in separate housings as described above. Each light source or emitter 301 is suitably constructed to emit a continuous beam of infrared light 321, while each light sensor 300 is a receiver or detector for the mating emitter. The emitters 301 are preferably arranged in a photo-reflector or diffused manner wherein the sensor or detector 300 will only detect the emitter signal when the light beam is reflected off of the barbell 302.

Figure 19:
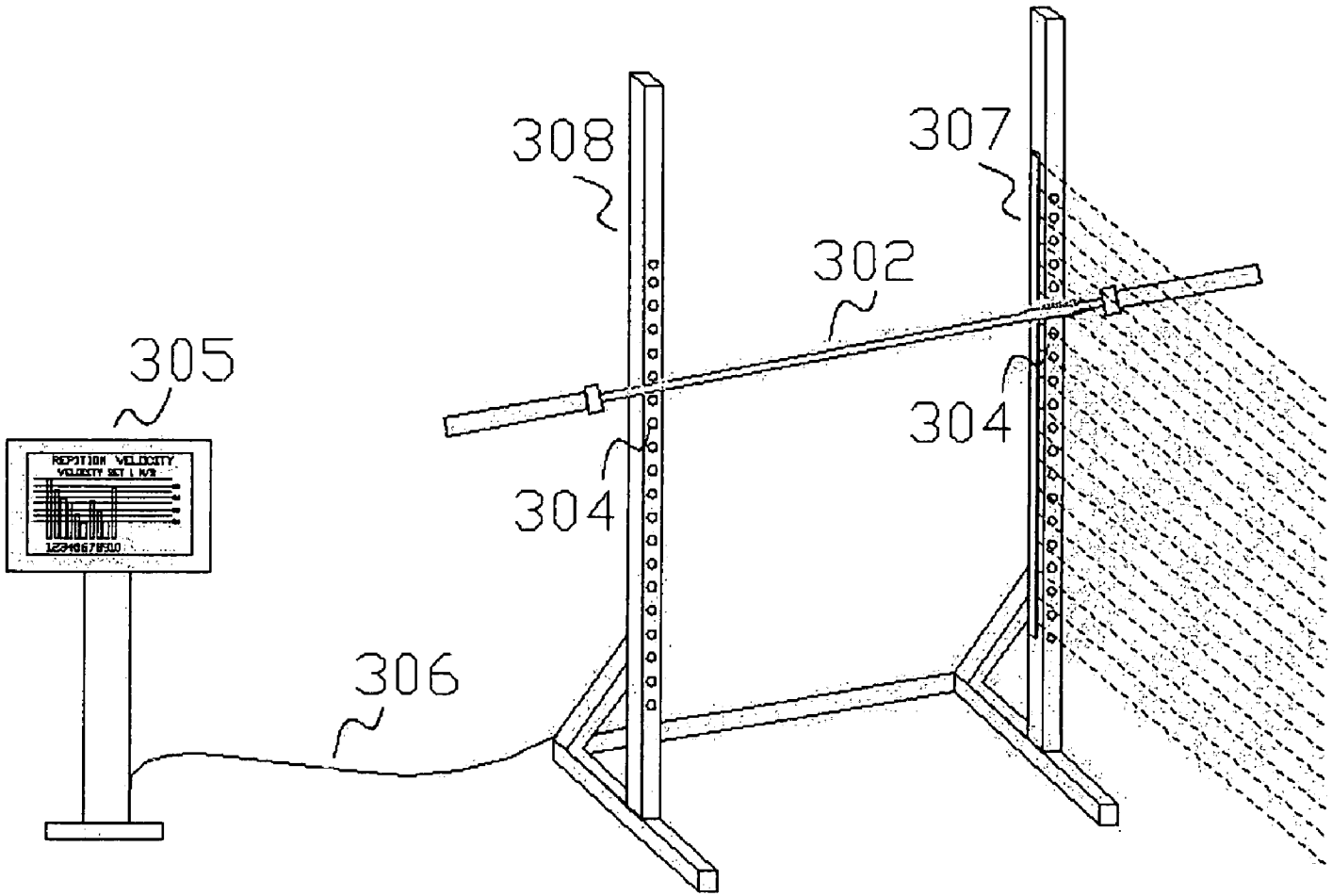
FIG. 19 is an isometric view of a half rack apparatus having the retrofittable portable exercise feedback apparatus of the invention as shown in FIG. 18 in use thereon wherein the light beams are emitted out in a horizontal direction and reflected off the barbell back to their mating detector devices.
Figure 20:
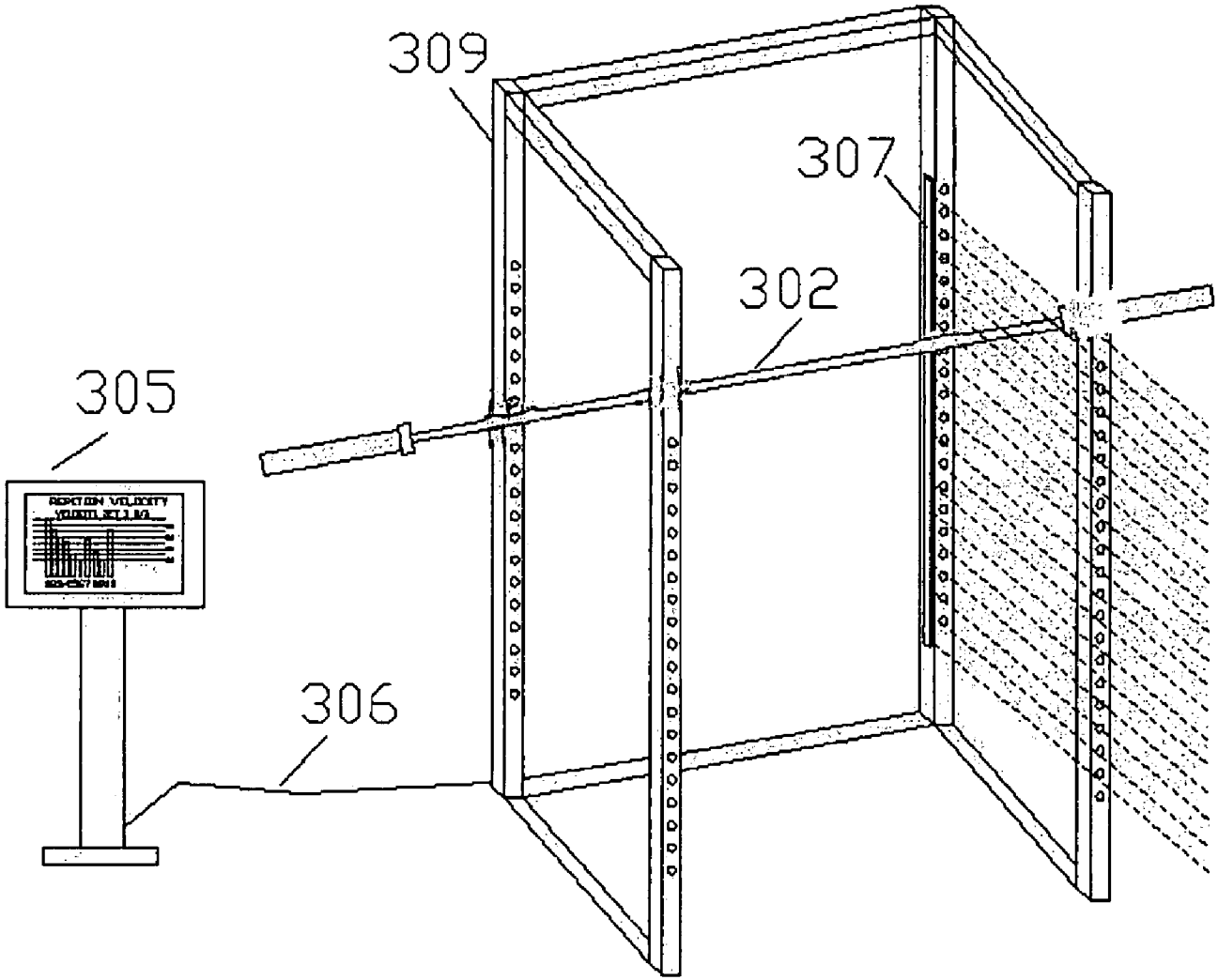
FIG. 20 is an isometric view of a power rack apparatus having the retrofittable portable exercise feedback apparatus of the invention as shown in FIG. 18 in use thereon and also illustrating use of the device on only one side of a weightlifting arrangement.

Light bar 303 is comprised of a housing or metal channel, see FIGS. 19-20, with pairs of closely spaced emitters 301 and mating detectors 300 arranged on the inside back surface of the housing with the emitters and detectors facing outwardly through a slot or opening in such channel. The metal channel not only shields the emitters and detectors from external damage, but provides a unitary mounting for the entire unit. The light bars 303 are attached to a vertical post or upright 307, preferably on the inner surface away from the weight plates on the ends of the barbell, of a half rack 308 having only two vertical posts, as shown in FIG. 19, or a power rack 309, as shown in FIG. 20, by magnets on the rear surface of the housings, clips, or other means. A second light bar 303 may be secured to the other vertical post or upright of a half rack or power rack if desired in a similar manner. The light bar device 303 should be positioned or arranged on the vertical upright so that it encompasses at least a substantial portion, and preferably the entire, range of motion of an exercise repetition. In other words, when the barbell exercise or repetition to be performed is carried out, the barbell 302 should pass through or reflect a light beam through the entire concentric (upward against gravity) and eccentric (downward against gravity) movement of the barbell. Together, the plurality of the light emitters 301 and detectors 300 housed in such a light bar device 303 create a light curtain through which a portion of the barbell must pass.

Figure 21:
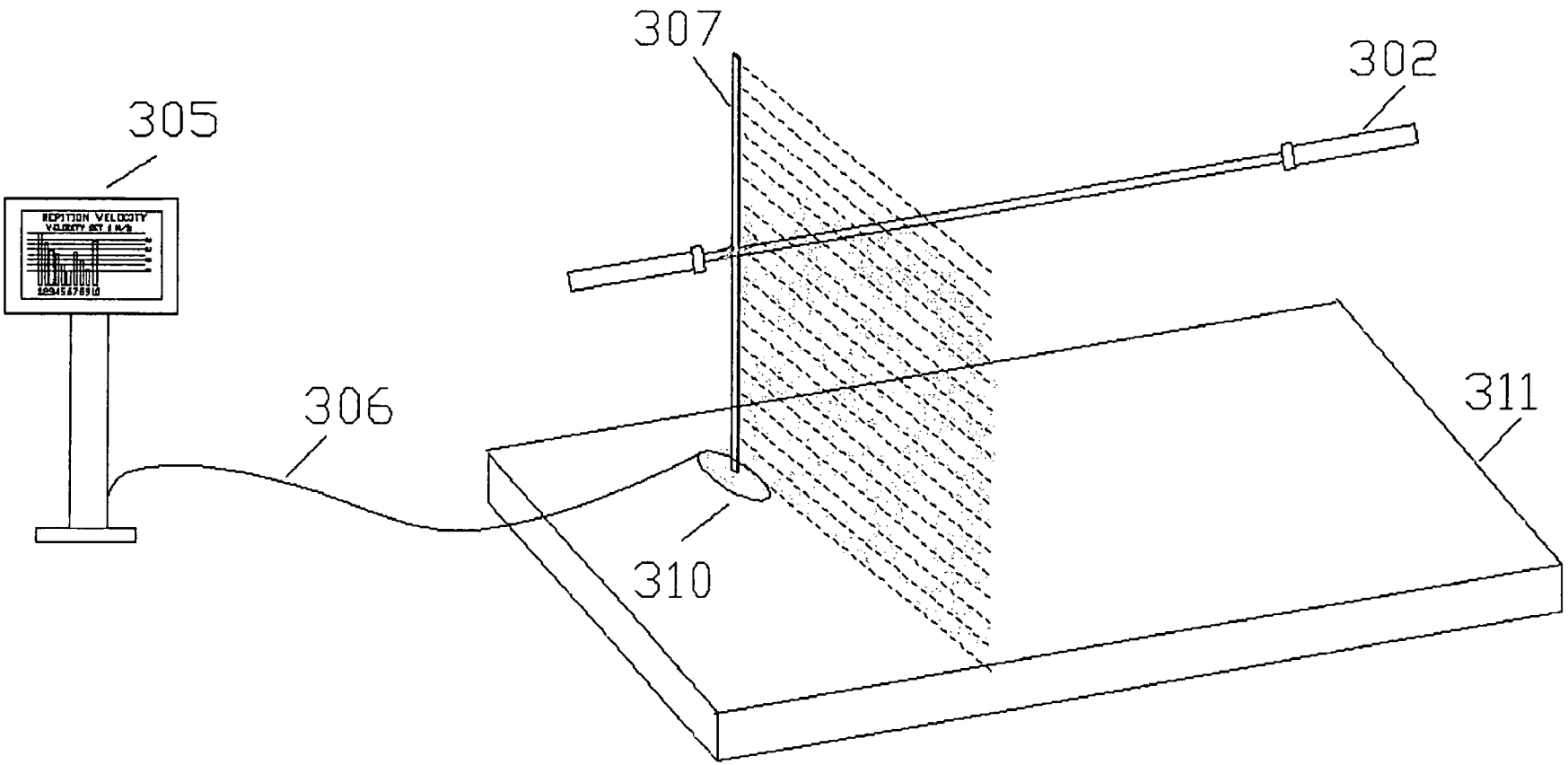
FIG. 21 illustrates the embodiment of the emitter/detector device of the invention shown in FIG. 18 designed to be freestanding rather than attached to a power rack or half rack.

FIGS. 19-21 illustrate several possible uses of the light emitter and detector device 303 of the invention shown and discussed with reference to FIG. 18. In FIG. 19, a half rack barbell support apparatus 308 used in performing free weight exercises is shown having the light bar or light emitting and detecting device 303 connected to vertical upright 307 with the light beams 321 directed outwardly from the emitters 301 (see FIG. 18) in a generally horizontally direction so that when barbell 302 is moved up and down vertically while performing an exercise, it will pass through the line of such light beams and the beams will be reflected back to their mating detectors 300. Preferably, the mating pairs of emitters and detectors are spaced apart not more than 15 centimeters of one another, and preferably the emitters and detector pairs are spaced only a few to several centimeters apart. In FIG. 19, light bar 303 is attached to the inner surface of vertical upright 307 of a half rack exercise apparatus 308, and in addition is connected electronically by lines or wires 306 to a microprocessor 305. Alternatively, a wireless communication system may be provided, similar to the arrangement illustrated in FIG. 17. A significant advantage of such embodiment of light bar 303 wherein the light emitter and detector devices are in the same housing is evident in FIG. 19, since the half rack barbell support apparatus 308 has only two side-by-side vertical uprights, rather than pairs of front and rear vertical uprights as in a full power rack barbell support apparatus. In the embodiment described above wherein the light emitters are in a first housing and the detectors are in a second housing situated opposite or across from the first housing, two uprights on which the housings could be mounted were required, while in the present embodiment only one upright is required on which the combined light emitter and detector device can be mounted. In addition, the setup time for mounting such device is decreased, since the two housings do not have to be separately mounted and the corresponding emitter and detectors devices properly aligned.

In FIG. 20, light emitter and detection device 303 is shown connected to a vertical upright 307 of a conventional frame or power rack apparatus 309 having four vertical uprights. Thus, both the presently described embodiment of the invention wherein the emitter and detector device are in the same housing, or the previously described embodiment wherein the emitter devices are in one housing and the detector devices are in a separate housing, can be used with a convention power rack. The light bar 303 containing both the emitters and detectors may be secured to any of the vertical uprights of power rack 309 as long as the light beams are directed so that the barbell will pass through the light curtain created by such beams when an exercise to be performed is carried out. FIG. 21 illustrates another convenient use of the present embodiment of the invention wherein rather than mounting the light bar 303 to an existing framework such as a half rack or power rack, the light bar is provided on or near a platform 311 or other flat surface in a freestanding arrangement, similar to the arrangement shown in FIG. 11 but now requiring only a single light bar rather than two. More particularly, the emitter and detector light bar 303 is supported in an upright position on a base or leg member 310. The free standing light bar 303 may be positioned next to a bench, power rack, half rack, platform or other apparatus, not shown, upon which a barbell 302 or dumbbells may be supported ready for use, or even adjacent to one lifting a barbell or dumbbell in a free-weight fashion. In particular, the light bar 303 is positioned so that the end of a barbell 302 or other weight with which an exercise is being performed extends through the light curtain created by the detector couple such that as the weight is moved in an up and down or concentric and eccentric motion, it will momentarily reflect the light beams, which reflection or motion is detected by the detector devices and then recorded in a manner described previously.

Figure 22:
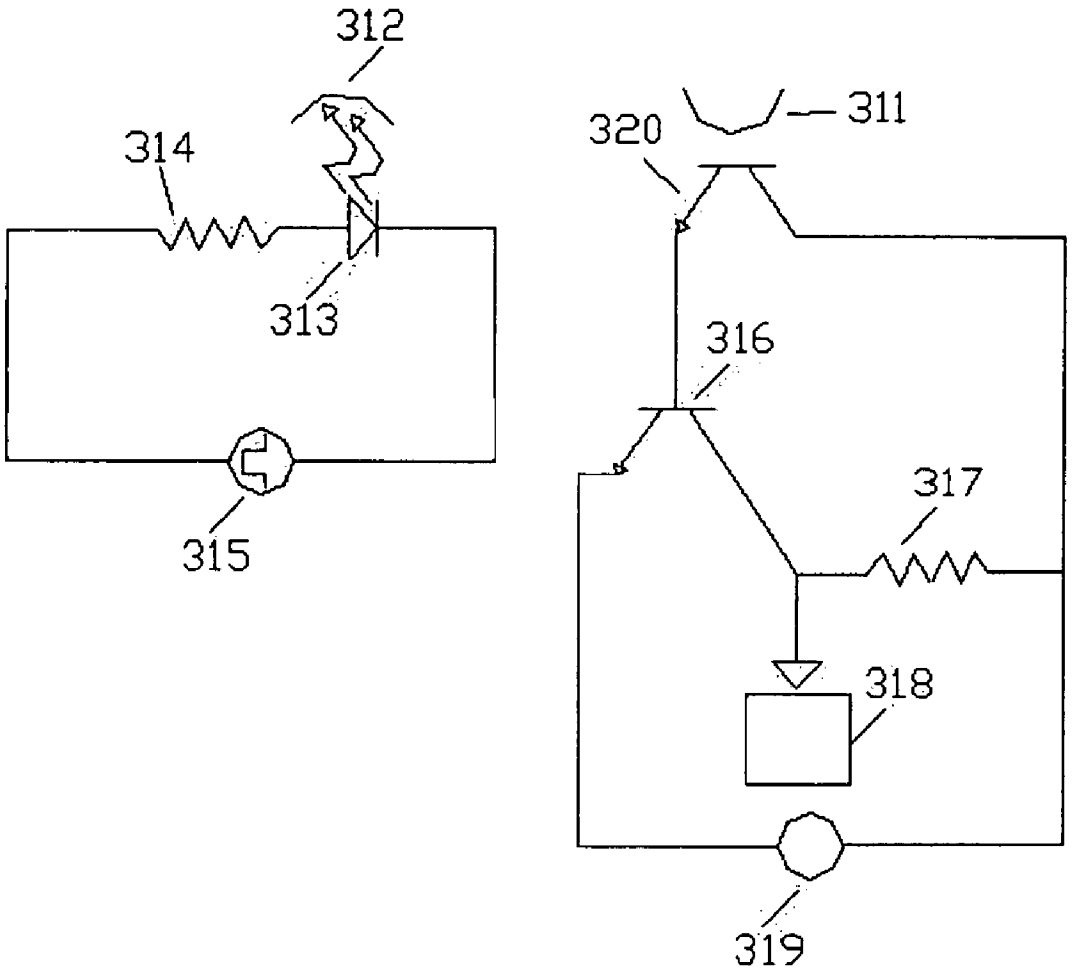
FIG. 22 is a diagrammatic view of the principle components of the electronic emitter and detector operating systems of the invention.

FIG. 22 is a circuit diagram illustrating a basic circuit for each of the light emitter and detector devices 313 and 320 used in the present invention. In the light source or emitter portion of the circuit, light emitting diodes are connected to a power source 315, with the circuit also including a resistor element 314. In the detector portion of the circuit for each detector device 320, the detectors are also operably connected to power source 315, with the circuit also including switching element 316, typically a transistor, and resistor element 317, while the light beams received by detectors 320 are filtered through an optical lens device 311 and sent or output to a microprocessor 318 for further evaluation and conversion into meaningful information or data. The emitter and detector circuits are, of course, hinged upon each other as two physical separate circuits attached through light 321. Satisfactory emitter devices 301 and satisfactory detectors devices are available in a single configuration from Pepper1 and Fuchs, part number RL28-8-H-2000-IR/49/115. It should be understood that various other emitter and detector devices having similar properties are suitable and may be used alternatively with the above exemplary devices.

Figure 23B:
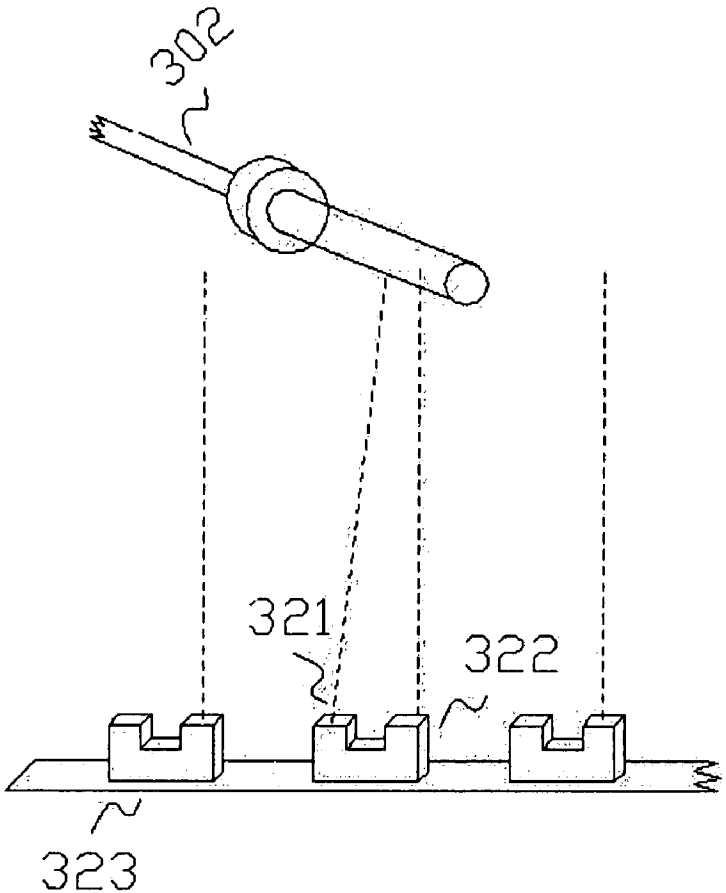
FIG. 23A and FIG. 23B is a diagram of the side sectional view of the emitter and detector portions of the apparatus of the invention applied to the spotter bar of a power rack, half rack or embedded in the frame of a platform, indicating the light beams by straight lines which are received by the detectors when a barbell reflects the light beams back to them.
Figure 23A:
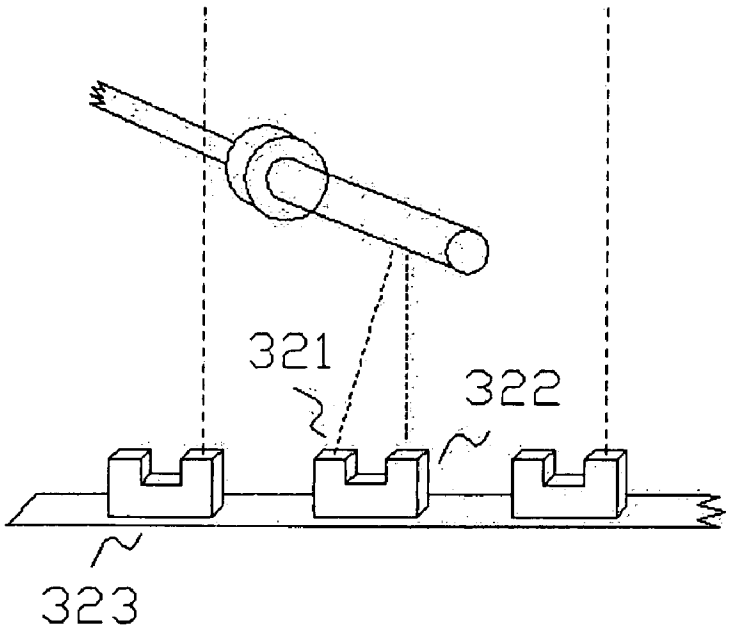
Figure 24:
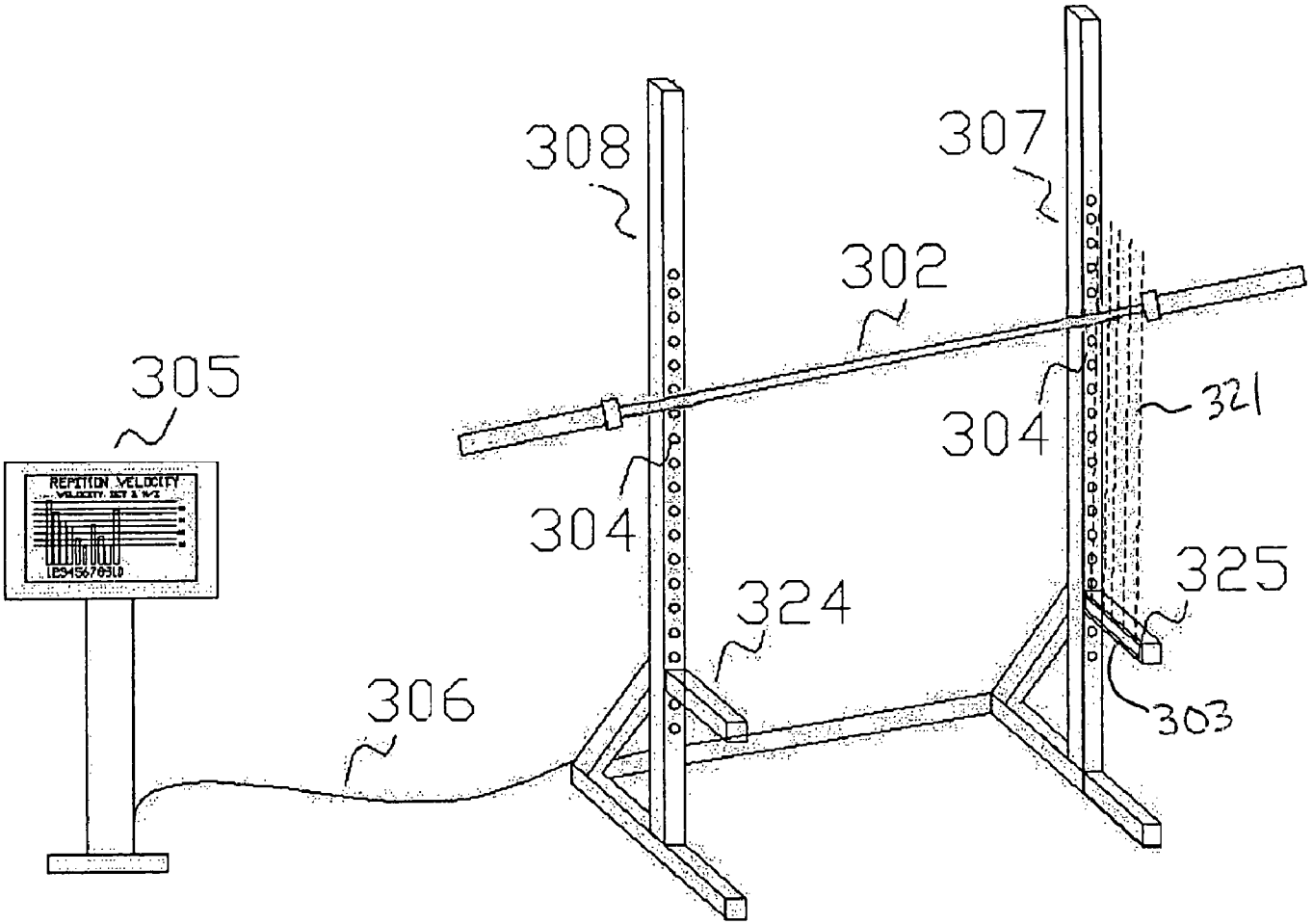
FIG. 24 is an isometric view of the frame or half rack apparatus with the retrofittable portable exercise feedback apparatus of the invention in use thereon with light beams emitting out in one vertical direction and reflecting off the barbell back to its mating detector device.

FIGS. 23A-23B and 24 illustrate another alternative arrangement in which the light emitting and detecting device of the present invention shown and described above with reference to FIGS. 18-22 can be used. More particularly, as an alternative to securing such light bar devices to a vertical upright of a power rack, half rack, or otherwise securing the light bar device in a vertical orientation by a separate standalone base so that the light beams are directed generally horizontally outwardly, in the present arrangement the light bar device is held in a generally horizontal plane so that the light beams are emitted in a vertical, preferably upward direction. FIG. 24 shows a half rack apparatus used in free weight exercises with the retrofittable portable exercise feedback system and apparatus of the invention in use therewith, with light bar 303 attached to the inner surface of the horizontal safety catch 325, away from the weight plates, with the light beams 321 being aimed upwardly as indicated by the dotted lines. Light bar 303 is then connected electronically by lines or wires 306 to a microprocessor 305. Alternatively, a wireless communication system may be provided similar the arrangement illustrated in FIG. 17, which replaces the need for the wire or line connection 306.

FIGS. 23A-B are diagrammatic side views illustrating one of the light emitting and detecting devices or light bars 323 arranged in a horizontal position with the light beams being directed vertically upward. In such arrangement, the light beams are similarly used to detect the position of barbell 302 as it is moved in a generally vertical direction within the light curtain created by the beams of light emitted from light emitters 322. In an alternative arrangement, a single light bar paired with separate light source units 322 and detector units 321 could be utilized. The light bar device 303 should preferably be positioned or arranged on the horizontal safety catch as shown in FIG. 24 so that it encompasses at least a single sensor detection of the barbell range of motion of an exercise repetition. In other words, when the barbell exercise or repetition to be performed is carried out, the barbell 302 should pass above or reflect a light beam through the entire concentric (upward against gravity) and eccentric (downward against gravity) movement of the barbell. The light emitter 322 emits a continuous beam of light, and as the barbell 302 moves toward or away from the emitter 322 the distance is sensed by the time interval it takes for the detector 321 to receive the reflected beam of light of its mating emitter 322. The closer the barbell 302 (FIG. 23A) is to the sensor apparatus 323, the shorter the time interval is for the light beam source 322 to reflect off the barbell 302 and back to the detector 321. Such time interval is recorded and generated into an analog output of a fixed value and then is stored in the microprocessor. FIG. 23B shows the barbell 302 on the same vertical plane at a further distance from sensor apparatus 323 which will create a longer time interval than in FIG. 23A, thus generating a different fixed analog output associated with the different light beam travel time interval and is also stored in the microprocessor. Each light source or emitter 322 is suitably constructed to emit a continuous beam of infrared light, while each light sensor 321 is a receiver or detector for the mating emitter. The emitters are preferably arranged in a photo-reflector or diffused manner wherein the detector will only detect the emitter signal of its mating emitter 322 when the light beam is reflected off of the barbell 302. As in the previous embodiments, the light bar is preferably constructed of a metal channel with closely spaced emitters 322 and paired directly beside its mating detector 321 provided along its back inside surface. The metal channel not only shields the emitters and detectors from external damage, but provides a unitary mounting for the entire unit. The variation of time or distance of the barbell from the detectors is directly related to the time it takes for the emitter light beam to travel, reflect off of the beam bar and be received by the detector.

Figure 25:
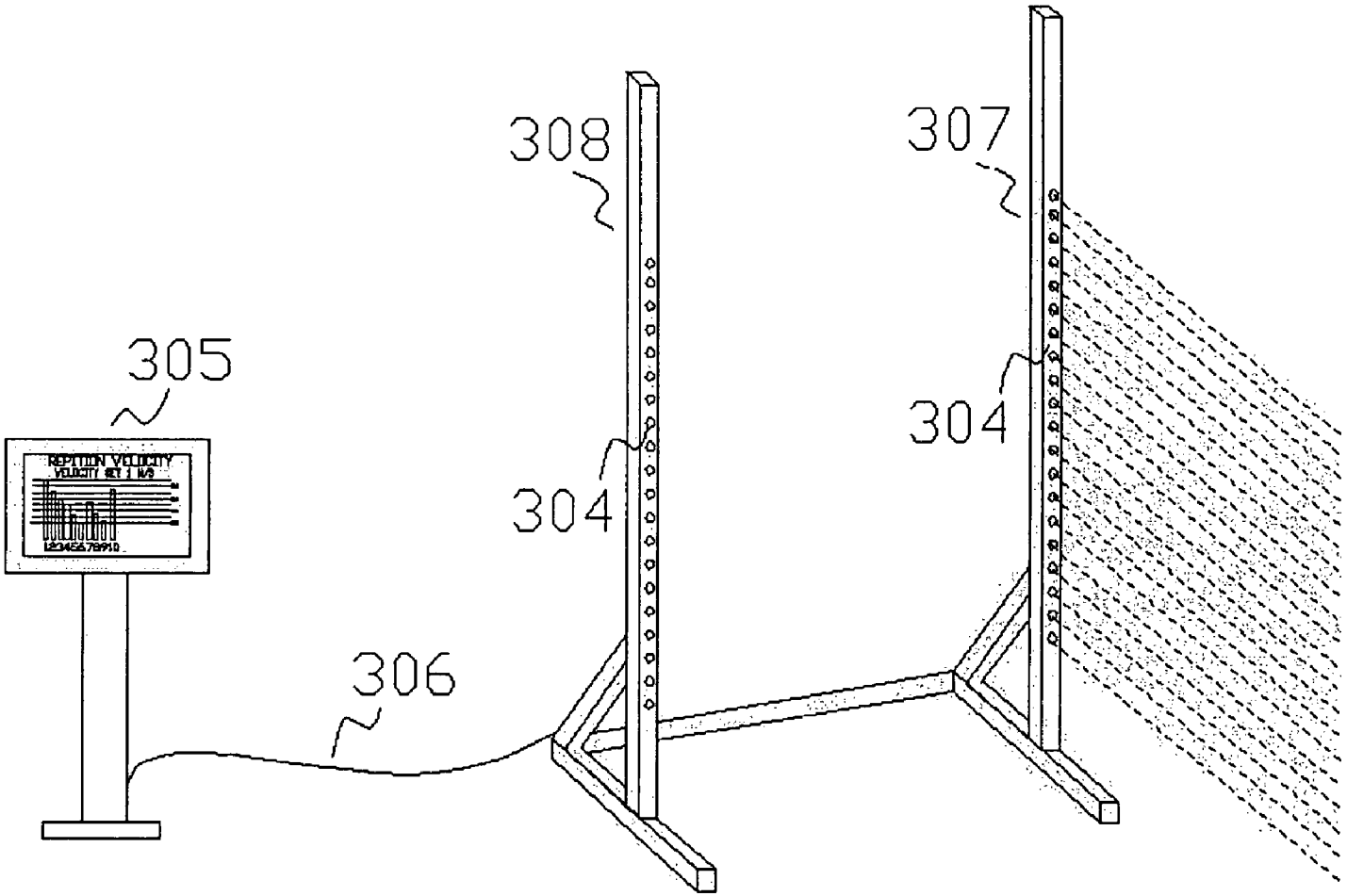
FIG. 25 is an isometric view of another alternative embodiment of the invention wherein the light emitter and detecting devices of the present invention are mounted inside the vertical uprights of a half rack apparatus.
Figure 26:
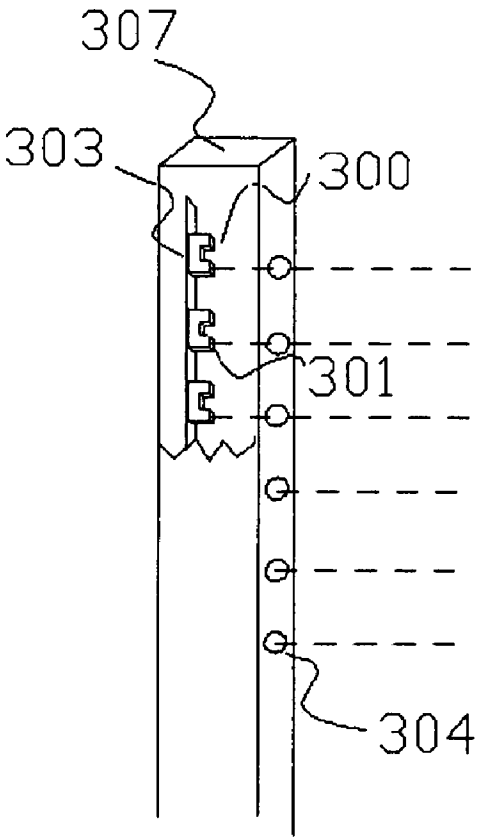
FIG. 26 is a partially cutaway view of the vertical upright of the half rack apparatus shown in FIG. 25 with showing the arrangement of the light emitter and detector device mounted in such upright.

FIG. 25 and FIG. 26 illustrate another alternative embodiment of the present invention wherein the light emitter and detector device is mounted in the interior of the vertical uprights of a half rack or power rack, rather than to one of the outer surfaces of the uprights as shown in the previous embodiments. Such light bars could also be mounted in the safety stopper devices, rather than to the outer surface of such devices as shown in FIG. 24. In FIGS. 25-26, the emitters 301 and detectors 300 are assembled in an isometric manner and mounted internally in the vertical post 307 of the power rack 309 or half rack 308. Various arrangements for mounting the light bars in the uprights, such as bolts, magnets, or adhesives, may be used, and the light bars may be either permanently or temporarily mounted in such uprights. The emitters 301 and detectors 300 are aligned in parallel with the existing mounting holes 304 in the vertical posts 307 of the half rack 308 and power rack 309. Alternatively, the uprights could be modified further to have separate holes with which the emitters and detectors would be aligned. The light bars are then connected to microprocessor 305 via wires 306, or alternatively a wireless connection could be utilized.

As will be understood from the foregoing description in connection with the appended drawings, the present invention provides a convenient and efficient way to obtain detailed data concerning the repetition, speed and power or force being attained in weight exercises and particularly in training for competitive free weightlifting. The apparatus is freely portable and retrofittable upon or in connection with power racks and the like and provides a very effective manner of effectively obtaining multiple data by retrofittable easily installable apparatus either installed permanently on power racks or the like or installed temporarily on or in conjunction with power racks and the like and easily transferred onto other racks, or similar equipment or multiple individual times on the same equipment from and to which it is easily removed and reinserted or instated.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim;

1. A system for gathering exercise parameter data during the performance of a free-weight lifting exercise comprising:

one or more portable elongated housings each supporting a plurality of aligned pairs of electromagnetic wave emitters and mating electromagnetic wave detectors mounted in said housing in a side by side relationship, electromagnetic waves produced by the emitters forming a light curtain;

a free weight barbell support structure having at least one vertical upright support, said vertical support structure supporting a barbell physically unconnected to said barbell support structure;

a means for removably connecting said one or more portable elongated housings to said vertical upright support in an operative position with a light curtain being projected by said emitters substantially in a horizontal plane and perpendicularly through the vertical range of motion of concentric and eccentric repetitions through which said barbell moves during performance of an exercise routine by an exerciser, whereby interruption of the wave emitted from each of said wave emitters and reflected off a surface of said barbell when moved by an exerciser into the path of said waves is record by each of said mating wave detector;

electronic means for gathering and converting information collected by said detectors into exercise parameter data as well as for storing said data; and a display panel for displaying said data;

wherein said waves are emitted in a diffuse pattern to prevent said detectors from detecting waves produced by adjacent wave emitters.

2. A system in accordance with claim 1 wherein two of said elongated housings are provided and are operatively aligned on said vertical upright supports so that the light curtain created by the electromagnetic waves emitted from said two housings intersect with different areas of the barbell as it is moved during performance of an exercise routine.

3. A system in accordance with claim 1 in which the elongated housings are securable in an operative position to a support surface of said vertical upright support by magnets provided on an outer surface of said housing.

4. A system in accordance with claim 1 wherein said elongated housing is comprised of a vertical support column of a weightlifting power rack or half rack, and wherein said pairs of emitters and detectors are mounted in the interior of said vertical support column with the emitters and detectors aligned with apertures in said vertical support column.

5. A system in accordance with claim 1 wherein there are multiple emitter/detector couples spaced not more that 15 centimeters from one another such that changes in acceleration and deceleration of movement may be detected by said spaced detectors of said emitter/detector couples said spaced detector couples.

6. A system in accordance with claim 5 wherein there are not less than 4 consecutive emitter/detector couples so spaced.

7. A system in accordance with claim 1 wherein said elongated housing may be operatively mounted to said at least one vertical upright support one of the vertical uprights of a full or half rack barbell support device with the light curtain projected forwardly across the range of motion of said barbell being moved through a repeating path during performance of a free-weight exercise routine.

8. A method of gathering weightlifting data and improving weightlifting performance by means of an electronic movement detector system comprising a series of spaced pairs of electromagnetic wave emitters and electromagnetic wave detectors housed in a common channel member, the pairs of emitters and detectors being coordinated with each other and electronically connected to a microprocessor and display panel comprising:

(a) moving the system components of the electronic movement detector system to a free-weight exercise site, and securing and aligning the channel member with the wave emitters directed so that the emitted waves are directed horizontally and will intersect only the path of travel of a barbell physically unconnected to a barbell support structure as it is moved vertically through a range of motion during performance of a free-weight lifting exercise;

(b) commencing a data gathering session by operating the electronic movement detector system while a weightlifter is performing a free-weight lifting exercise with a section of the barbell passing through the emitted waves as many times as the free-weight lifting exercise is performed, which passage causes the waves to be reflected off a surface of the barbell and detected by the corresponding detector pair;

(c) ending said data gathering session and operating the electronic movement detector system using collected data from said data gathering session to calculate various exercise parameters including the velocity, power, acceleration, deceleration, and rapidity of movement of the barbell based upon said data of the movements of the barbell as the weightlifter performs free-weight lifting exercises, and calculating anatomical data of the weightlifters body based upon said data provided by the height and rapidity of the reflections of the waves; and (d) displaying the results of such calculations on the electronic display means.

9. A method in accordance with claim 8 wherein the channel members are provided with magnetic members which when the system components are moved to an exercise site and are brought into contact with a metal structure of said support structure such that the channel member is secured to an end post of said support structure with the emitters vertically aligned.

10. A method in accordance with claim 8 wherein the data is stored in a memory of the system for further reference.

* * * * *